US007075445B2

(12) United States Patent
Booth et al.

(10) Patent No.: US 7,075,445 B2
(45) Date of Patent: Jul. 11, 2006

(54) RAPIDLY RESPONDING, FALSE DETECTION IMMUNE ALARM SIGNAL PRODUCING SMOKE DETECTOR

(75) Inventors: David K. Booth, Tigard, OR (US); Douglas H. Marman, Ridgefield, WA (US); Gary E. Friar, Tigard, OR (US)

(73) Assignee: GE Security, Inc., Bradenton, FL (US)

( * ) Notice: Subject to any disclaimer, the term of this patent is extended or adjusted under 35 U.S.C. 154(b) by 155 days.

(21) Appl. No.: 10/645,354

(22) Filed: Aug. 20, 2003

(65) Prior Publication Data

US 2004/0063154 A1 Apr. 1, 2004

Related U.S. Application Data

(60) Provisional application No. 60/405,599, filed on Aug. 23, 2002.

(51) Int. Cl.
*G08B 17/10* (2006.01)

(52) U.S. Cl. ..... 340/630; 356/338

(58) Field of Classification Search ..... 340/630; 356/335–338

See application file for complete search history.

(56) References Cited

U.S. PATENT DOCUMENTS

| | | | | |
|---|---|---|---|---|
| 3,316,410 A | | 4/1967 | Meili et al. | 250/218 |
| 3,566,385 A | | 2/1971 | Lawson | 340/228 |
| 3,739,365 A | | 6/1973 | Müller | 340/228 |
| 3,748,014 A | * | 7/1973 | Beiser | 359/201 |
| 3,765,842 A | | 10/1973 | Purt | 23/232 |
| 3,872,315 A | | 3/1975 | Boll | 250/575 |
| 3,880,526 A | | 4/1975 | Kobayashi et al. | 356/208 |
| 3,921,158 A | | 11/1975 | Anderson | |
| 3,922,655 A | | 11/1975 | Lecuyer | 340/237 |
| 3,994,603 A | | 11/1976 | Paschedag | 356/205 |
| 4,221,485 A | | 9/1980 | Schulze | 356/338 |
| 4,547,675 A | | 10/1985 | Muggli et al. | 250/565 |
| 4,651,013 A | | 3/1987 | Kajii et al. | 250/573 |

(Continued)

FOREIGN PATENT DOCUMENTS

EP 0 290 413 A2 11/1988

(Continued)

*Primary Examiner*—Jeffery Hofsass
*Assistant Examiner*—Jennifer Mehmood
(74) *Attorney, Agent, or Firm*—Baker & Hostetler LLP

(57) ABSTRACT

A smoke detector of an obscuration type has an effective light propagation path of substantially greater length than the light propagation paths of conventional obscuration-type smoke detectors to provide increased smoke detection sensitivity without increased background noise or numbers of false alarm incidents. The smoke detector has a light source that emits a light beam that propagates into a detection chamber composed of first and second optical components having respective first and second opposed light reflecting surfaces. The light reflecting surfaces reflect the light beam across the detection chamber multiple times before the reflected light beam is incident on a light detector. The multiple reflections of the light beam increase its effective path length of propagation within the detection chamber to provide the increased smoke detection sensitivity.

31 Claims, 17 Drawing Sheets

U.S. PATENT DOCUMENTS

| | | | | | |
|---|---|---|---|---|---|
| 4,675,661 | A | | 6/1987 | Ishii | |
| 4,839,527 | A | | 6/1989 | Leitch | 250/573 |
| 4,857,895 | A | | 8/1989 | Kaprelian | 340/630 |
| 5,009,493 | A | | 4/1991 | Koch et al. | 350/619 |
| 5,502,434 | A | | 3/1996 | Minowa et al. | 340/630 |
| 5,546,074 | A | | 8/1996 | Bernal et al. | 340/628 |
| 5,576,697 | A | * | 11/1996 | Nagashima et al. | 340/630 |
| 5,798,701 | A | | 8/1998 | Bernal et al. | 340/628 |
| 5,841,534 | A | * | 11/1998 | Lorenz | 356/336 |
| 6,011,478 | A | | 1/2000 | Suzuki et al. | 340/630 |
| 6,225,910 | B1 | | 5/2001 | Kadwell et al. | 340/630 |
| 6,876,305 | B1 | * | 4/2005 | Kadwell et al. | 340/630 |

FOREIGN PATENT DOCUMENTS

| | | |
|---|---|---|
| EP | 0 321 265 B1 | 8/1994 |
| JP | 52-080880 A | 7/1977 |
| JP | 2001 34863 | 2/2001 |
| WO | WO 99/19852 | 4/1999 |
| WO | WO 00/07161 | 2/2000 |

* cited by examiner

RAPIDLY RESPONDING, FALSE DETECTION IMMUNE ALARM SIGNAL PRODUCING SMOKE DETECTOR

RELATED APPLICATION

This application claims benefit of U.S. Provisional Patent Application No. 60/405,599, filed Aug. 23, 2002.

TECHNICAL FIELD

The present invention relates to smoke detectors and, in particular, to a rapidly responding, false detection immune smoke detector of the obscuration type having increased sensitivity and a decreased incidence of false alarms.

BACKGROUND OF THE INVENTION

Two types of particle smoke detectors are ionization-type detectors and photoelectric-type detectors. In an ionization-type smoke detector, a very low ionic current flows from one side of a detection chamber to the opposite side. A stream of air also flows through the detection chamber such that particles, including smoke particles, entrained in the air-stream alter the ionic current flow. A change in ionic current flow is detected by a detector that activates an alarm indicating the presence of smoke particles. In a photoelectric-type smoke detector, a light source, typically an LED, and a light detector are mounted at an acute angle to each other inside a detection chamber that is shielded from stray light. Light emitted by the light source is scattered by smoke particles entering the detection chamber. The incidence of the scattered light on the light detector activates an alarm.

Because they are more sensitive to relatively small (i.e., less than about 1.0 micron in diameter) airborne particles produced during the early phases of a fire, ionization-type smoke detectors respond to flaming fires faster than do photoelectric-type smoke detectors. However, smoke detectors that are sufficiently sensitive to detect the weakest signal from the most incompatible type of smoke will automatically be overly sensitive to the most compatible types of smoke. Thus, ionization-type smoke detectors have a high incidence of false alarms. For example, ionization-type smoke detectors detect small, non-smoke particles, including cooking, cleaning fluid, and paint fume particles.

In contrast, photoelectric-type smoke detectors quickly respond to relatively large (i.e., greater than about 1.0 micron in diameter) smoke particles generated by smoldering fires. However, because the color of the smoke greatly affects the amount of light that is scattered, photoelectric-type smoke detectors respond to black smoke much more slowly than they respond to white smoke.

Ionization-type and photoelectric-type smoke detectors suffer from a number of other deficiencies as well. One deficiency is their high sensitivity to dust and dirt accumulation in the detection chamber. In ionization-type smoke detectors, the presence of dust decreases conductivity and thereby distorts the ionic current flow. In photoelectric-type smoke detectors, dust accumulated on the detection chamber walls scatters light onto the light detector and thereby causes false alarms and increases background noise. Further, the dust layer that may accumulate on the sides, top, or bottom of the detection chamber will have a higher reflectivity than a conventional black detection chamber wall. Hence, stray light propagating from the light source will reflect off this dust layer and cause an increase in the amount of light that reaches the light detector. The light detector responds to this increase by producing an output that indicates the presence of smoke particles and consequently activates an alarm.

Because the presence of dust in smoke detectors cannot be avoided, most commercial fire codes mandate that regular testing and cleaning procedures be instituted to avoid excessive dust accumulation resulting in improper operation. Cleaning the detectors is expensive and time-consuming. An attempt to minimize the amount of dust that settles on the walls of the detection chamber is described in Japanese Patent Application No. 11207817, which describes a smoke detector having an air feeding tube that periodically sprays air onto the light detector and thereby removes any dirt or dust thereon.

Another deficiency of ionization-type and photoelectric-type smoke detectors is their sensitivity to wind and outside light sources. Specifically, ionization-type detectors cannot be used in air ducts or near wind drafts because excessive air flow can blow the ions out of the detection chamber. Photoelectric-type detectors are highly sensitive to outside light sources. To reduce the effect of wind drafts and outside light, smoke detector manufacturers generally design the detection chamber to include partitions and walls that block dust and light emitted by outside light sources. However, these partitions and walls often significantly decrease the flow of air carrying smoke particles into the detection chamber.

One attempt to provide a smoke detector with increased sensitivity and a reduced incidence of false alarms entailed creating a combination ionization-type/photoelectric-type smoke detector. When combined in a logical "OR" configuration, the combination smoke detector responded more rapidly to many of the different types of smoke, but the incidence of false alarms increased. When combined in a logical "AND" configuration, the incidence of false alarms was reduced, but the smoke detector displayed decreased sensitivity to many of the different types of smoke.

A second attempt to provide a smoke detector with increased sensitivity and a reduced incidence of false alarms entailed creating a light obscuration-type smoke detector that included a photoelectric-type sensor. Obscuration-type smoke detectors typically include a detection chamber having a light source at one end and a light detector at the opposite end. The detection chamber further includes openings through which smoke particles may enter. Smoke particles present in the optical pathway between the light source and the light detector scatter light emitted by the light source. The light detector measures the loss of light caused by smoke particles entering the detection chamber and partly blocking the light emitted by the light source. Once the measured loss of light exceeds a predetermined threshold, the light detector, through suitable electronics, actuates an alarm. Thus, obscuration-type smoke detectors measure the degree of obscuration of light incident on the light detector resulting from the presence of smoke particles in the optical pathway between the light detector and the light source.

Although the light obscuration method of smoke detection is highly accurate and is used as the standard against which ionization-type and photoelectric-type smoke detectors are measured, many obscuration-type smoke detectors suffer from an unacceptably high incidence of false alarms because of their small light beam path length of about 5 cm to about 8 cm (about 0.17 ft to about 0.26 ft). Most particle obscuration-type smoke detectors signal an alarm when the smoke is present at a threshold level of about 2.5%/ft of obscuration. Thus, a beam length of one foot translates to a 2.5% loss of light. In contrast, a light beam path length of only 5 cm to 8 cm translates to a 0.4% to 0.6% loss of light.

Smoke detectors having this low threshold level are highly unreliable because they exhibit large numbers of false alarms.

What is needed, therefore, is an improved smoke detector that is consistently sensitive to a wide range of the many types of smoke, including small- and large-diameter smoke particles and various colors of smoke, while exhibiting a reduced incidence of false alarms.

SUMMARY OF THE INVENTION

An object of the present invention is to provide a faster detecting, highly reliable smoke detector that is sensitive to many different types of smoke but has a reduced number of false alarm incidents.

The smoke detector of the present invention is of an obscuration type that has an effective light propagation path of substantially greater length than the light propagation paths of conventional obscuration-type smoke detectors to provide increased smoke detection sensitivity without increased background noise or numbers of false alarm incidents. The smoke detector has a light source from which a light beam propagates into a detection chamber composed of first and second optical components having respective first and second opposed light reflecting surfaces that reflect the light beam across the detection chamber multiple times before the reflected light beam is incident on a light detector. The first and second light reflecting surfaces are positioned such that light emitted by the light source alternately reflects off of them, thereby increasing the effective path length of the light beam propagating within the detection chamber.

In a preferred embodiment, the first and second light reflecting surfaces are those of two mirrors between which a light beam is reflected five times such that it makes six trips across the chamber before incidence on the light detector. The effective path length of a light beam propagating through a smoke detector of this embodiment is six times longer than the actual path length between the two light reflecting surfaces. Thus, a path length of about 36 cm (about 1.2 ft) can be achieved in a detection chamber that is about 6 cm (about 2.4 in) long. The resultant smoke detector exhibits increased sensitivity without a subsequent increase in background noise, thus increasing the signal to noise ratio and thereby reducing the rate of incidence of false alarms. The obscuration-type detector of the present invention does not undergo significant diminution in signal-to-background noise ratio in response to accumulation of dust on the detector chamber walls because a 2.5% level of obscuration will still result in a 2.5% drop in light signal.

Preferred embodiments of the invention are implemented so that the width of the fan of light rays characterizing the light beam emitted by the light source covers a significant portion of the area of the detector chamber to render insignificant contributions of anomalous light reflections caused by individual particles (e.g., dust or dirt) on the chamber walls. Spreading the light beam across the detection chamber ensures that the reflected light emerging from the detection chamber represents an average concentration of smoke without significant contributions by hot spots present in the detection chamber. The smoke detector preferably contains at least one concave mirror to reimage the reflected light beams such that the light beam exiting the detection chamber converges to a narrow focus and thereby has a beam width that is sufficiently narrow to be substantially confined to the area of the light receiving surface of the light detector. Confining the light beam to the area of the light receiving surface of the light detector maximizes the accuracy of the detector output signal representing the amount of smoke present in the detection chamber.

The present invention is capable of operating with a light source having a wavelength smaller than that of near infrared light, which is currently used by photoelectric detectors. When the diameters of the entrained particles are smaller than the wavelength of the light source, the light passes around the particles with no deflection, i.e., they become invisible to the light source. The wavelength of the light source dictates, therefore, the particle size that can be detected by a photoelectric-type detector. This is the reason why photoelectric detectors currently using infrared light emitting diodes (LEDs) as their light source can detect only particle sizes larger than about 1 micron.

Preferred embodiments of the invention use a blue LED source emitting a 430 nm light beam, although any light source emitting a light beam having a wavelength shorter than that of near infrared light could also be advantageously used. The shorter wavelength light source provides a smoke detector that is capable of much earlier detection of flaming type fires, which produce smaller particle sizes. Since most fires produce a larger portion of particles of much less than 1 micron in size, use of a smaller wavelength light source results in a significant improvement in early response to fire.

The faster detecting, more highly reliable photoelectric smoke detector of the present invention overcomes a serious weakness of currently available spot-type detectors. The present invention responds faster than prior art photoelectric-type smoke detectors, especially to flaming type fires because they produce mostly smaller than 1 micron particles and often black smoke. Yet the present invention avoids responding to particles of sizes smaller than 0.1 micron, which are often causes of false detection.

The present invention responds consistently to the whole spectrum of smoke particles of sizes greater than 0.43 micron, irrespective of the color of the smoke. This is a significant improvement over ionization-type and light scattering photoelectric-type smoke detectors. The improved consistency helps significantly in the manufacturing process by facilitating relatively straightforward calibration.

The present invention can be used to distinguish between flaming fire and smoke. This is accomplished through the use of two light sources emitting light beams of different wavelengths. If, for example, a blue light source and a red or infrared light source are used, the difference in obscuration between their respective wavelengths can describe the type of smoke and fire being detected. Flaming fires, for example, produce much larger obscuration of blue light, proportionately to red light, than smoldering fires produce. Smoke detectors of the present invention implemented with two light sources emitting light of different wavelengths can, therefore, be used to notify the responding fire officials where flames are located in a burning building or where only smoke is present.

Use of optical narrow band filters would further enhance the highly selective possibilities of the present invention, especially when the possible constituents are known and limited (such as monitoring a fuel burning operation). If it is available at an inexpensive price, such a smoke detector could be virtually disposable in that it would be replaced when dirt accumulation renders the smoke detector inoperable.

One aspect of the present invention is that it can be implemented in a self-contained smoke detector that has such internal self-diagnostic and self-adjustment capabilities. A self-diagnostic smoke detector is described in U.S. Pat. No. 5,546,074, and a self-adjusting smoke detector is described in U.S. Pat. No. 5,798,701. Both of these patents are assigned to the assignee of this patent application. The smoke detector of the present invention can be constructed to have an extended, cleaning maintenance-free operational life. This can be accomplished by providing the smoke detector having self-diagnostic and self-adjustment capabilities with drift compensation implemented with a high precision (i.e., 10 bit) floating background adjustment and synchronous detection circuitry implemented to take time-displaced groups of multiple samples and average them to eliminate background noise in the detection chamber.

The smoke detector of the present invention is suitable for installation completely within an air duct because the detector chamber is not affected by air duct wind current, which seriously affects the performance of ionization-type detectors, and is much less sensitive to air duct dust haze, which is a significant problem for light scattering photoelectric-type detectors.

Additional objects and advantages of this invention will be apparent from the following detailed description of preferred embodiments, which proceeds with reference to the accompanying drawings.

DETAILED DESCRIPTION OF PREFERRED EMBODIMENTS

Figure 1:
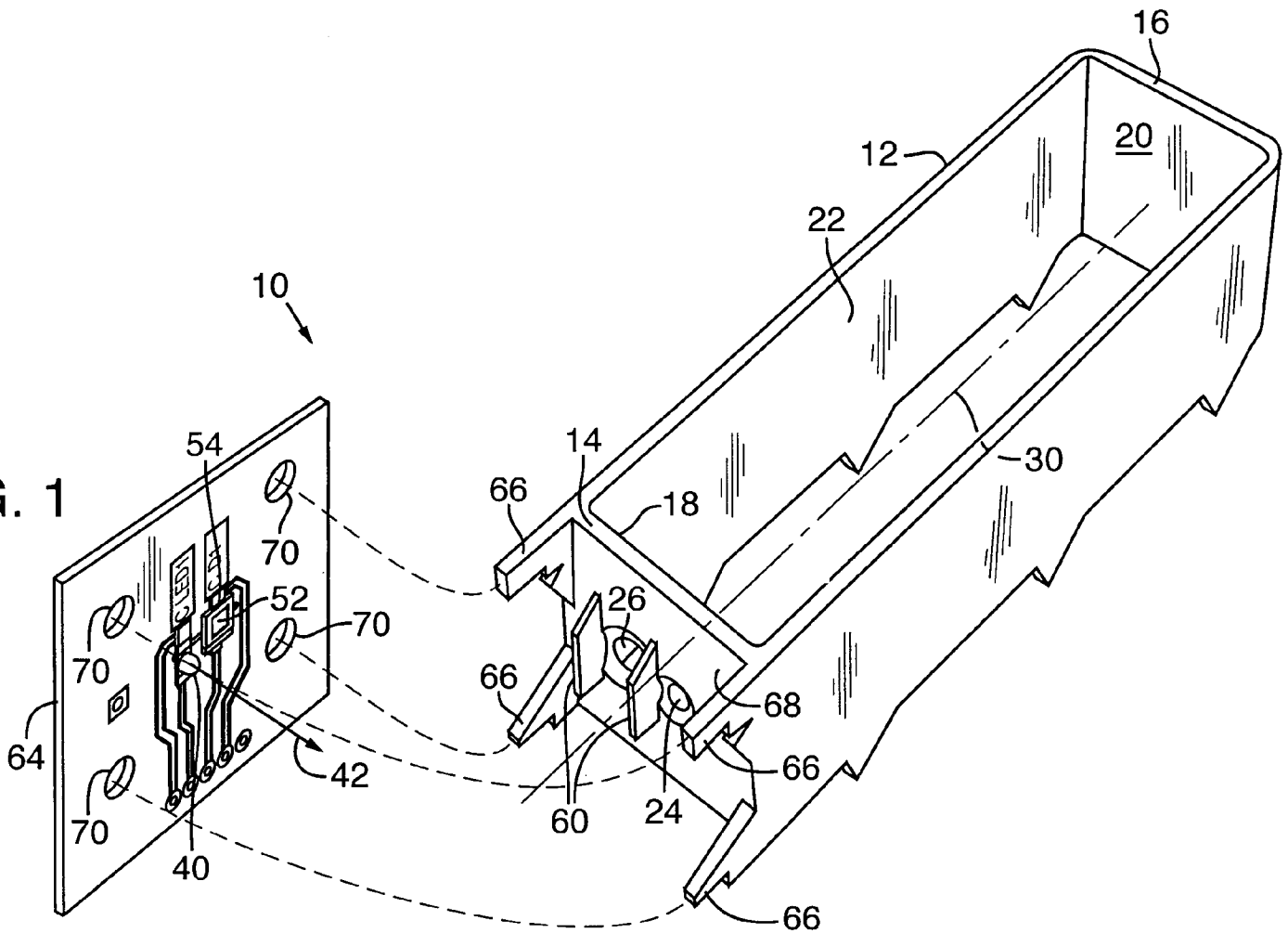
FIG. 1 is an exploded isometric view of a first embodiment of a smoke detector of the present invention in which a light source and a light detector are positioned adjacent the same one of two detection chamber light reflecting surfaces.

The smoke detector of the present invention is a rapidly responding, false detection immune smoke detector of an obscuration-type. FIG. 1 shows a first preferred embodiment in which a light source and a light detector are positioned adjacent the same one of two light reflecting surfaces of a detection chamber. With reference to FIG. 1, a smoke detector 10 includes a light reflective imaging assembly or detection chamber 12 formed of first and second optical components 14 and 16 having respective light reflecting surfaces 18 and 20 that are spaced apart to create an interior spatial region 22 through which air carrying smoke particles can pass. Optical component 14 has first and second openings 24 and 26 through which a light beam can, respectively, enter and exit detection chamber 12. Openings 24 and 26 are preferably equidistantly spaced from and positioned on opposite sides of an optical axis 30 extending through and along the length of detection chamber 12.

A light source 40 emits a light beam 42 that enters detection chamber 12 by propagating through first opening 24 for reflection by light reflecting surfaces 18 and 20 within interior region 22 of detection chamber 12. Upon completion of multiple reflections off of light reflecting surfaces 18 and 20, light beam 42 emerges from detection chamber 12 by propagating through second opening 26 for incidence on a light receiving surface 52 of a light detector 54. The intensity of light beam 42 incident on light receiving surface 52 is indicative of the number of smoke particles present in interior region 22 of detection chamber 12. One or more shrouds 60 (two linear shrouds are shown in FIG. 1 but one circular shroud would be a suitable alternative) are preferably positioned to prevent unreflected light emitted by light source 40 or a secondary light source from being directly incident on light detector 54. Shrouds 60 are shown affixed to the exterior surface of first optical component 14 in FIG. 1, but the shape, size, and positioning of each of them are merely exemplary and will be dictated by the constraints of each smoke detector.

Figure 2B:
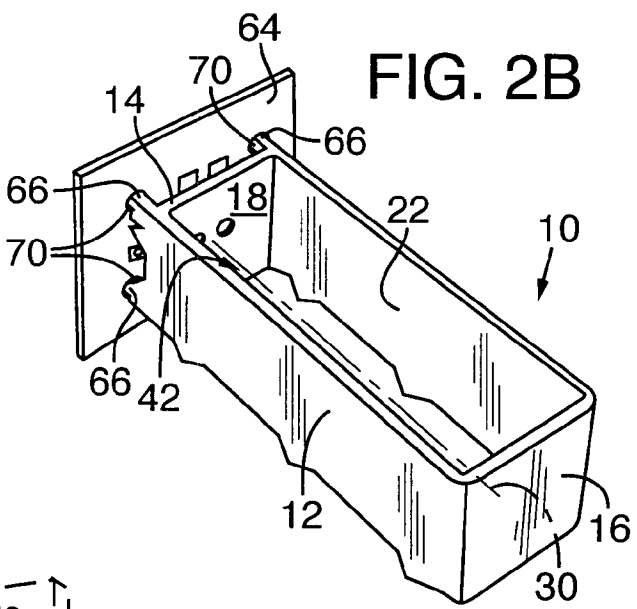
FIGS. 2A, 2B, and 2C are three different isometric views of the smoke detector of FIG. 1.
Figure 2A:
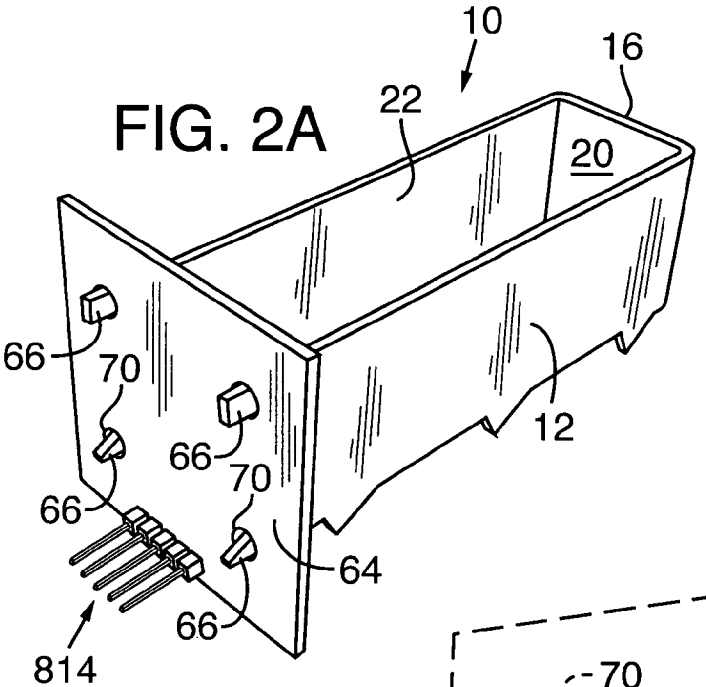
Figure 2C:
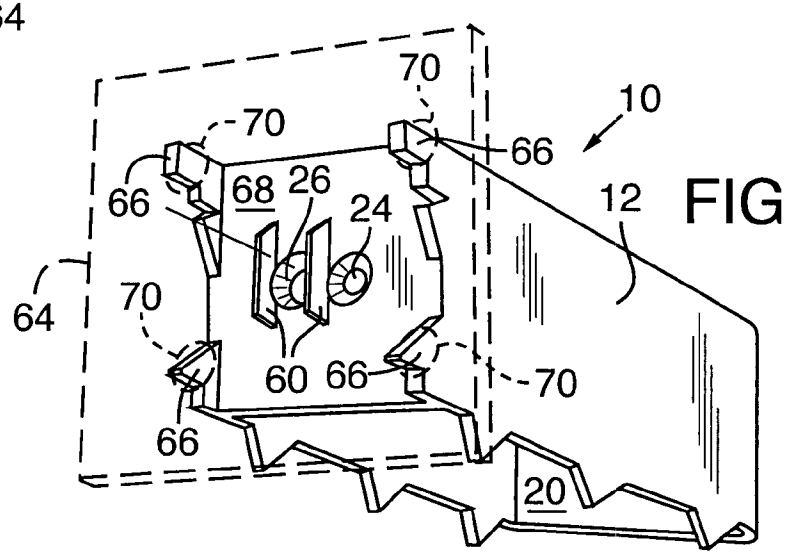

As shown in FIG. 1, the smoke detector is preferably composed of two pieces: (1) an integrally molded generally rectangular, open-sided detection chamber 12 having two spaced-apart optical components 14 and 16 that have respective first and second interior surfaces 18 and 20 confronting each other and preferably coated with a light reflecting material, and (2) a circuit board 64 on which light source 40 and light detector 54 are surface mounted. As shown in FIGS. 2A, 2B, and 2C, multiple arms 66 extend from an exterior surface 68 of first optical component 14 and may be slidably fit through multiple corresponding apertures 70 in circuit board 64 to maintain alignment of detection chamber 12 and circuit board 64. Because misalignment of detection chamber 12 and circuit board 64 would result in an off-axis shifting of light source 40 and light detector 54, it is preferable to permanently affix these two pieces using any known fixation method, including glue or thermal adhesion, to ensure that they do not become misaligned during operation.

As stated above, light beam 42 propagates between and reflects off of light reflecting surfaces 18 and 20 multiple times before it is incident on light receiving surface 52 of light detector 54. These multiple reflections create an effective path length that is greater than the distance separating light reflecting surfaces 18 and 20. In a preferred implementation of the second preferred embodiment, which is described in detail below with reference to FIGS. 4D and 5, light beam 42 reflects off of first and second light reflecting surfaces 18 and 20 to make six trips across detection chamber 12 before incidence on light receiving surface 52 of light detector 54.

Light detector 54 detects the light propagating through opening 26 and, in response, produces an output signal that is used to produce an alarm signal. Under smoke-free conditions, light detector 54 receives a maximum light output of light source 40. If during a prescribed time interval there are multiple occurrences of light incident on light detector 54 falling below a threshold level in response to the presence of smoke particles in detection chamber 12, the output signal level of light detector 54 falls below the predetermined threshold for each occurrence and a comparator (not shown) sends a signal that generates an alarm. The threshold level can be a fixed light output value, a value established by rate of change of light output level, or a combination of both of them. A typical threshold level is between about 1%/ft and about 10%/ft below the smoke-free light output level.

An accumulation of dust on the walls of a detection chamber configured in accordance with the prior art increases its reflectivity and thereby acts as a significant secondary light source that, in the presence of a given level of smoke, counteracts the light attenuation induced by the smoke particles. Elimination of dirt and dust build-up would require constant cleaning, resulting in high maintenance costs. A preferred, less expensive method of compensating for dirt and dust build-up entails providing in the smoke detector drift compensation circuitry implemented with a floating background adjustment (described below) that compensates for slow changes in the ambient output signal level of high detector 54 caused by dust accumulation in detection chamber 12.

A preferred light source 40 is a light-emitting diode (LED). An alternative light source includes a laser, an arc lamp, or an LED having an integral lens. Light emitted by light source 40 may be infrared, ultraviolet, or visible light but preferably has a wavelength of less than about 800 nm, and more preferably between 350 nm and 470 nm. A preferred light source 40 emits blue light having a wavelength of between about 410 nm and about 470 nm. A light source in a wavelength range generally corresponding to blue light, instead of the 880 nm infrared light beam used in prior art light scattering photoelectric detector systems, results in a potential detection sensitivity increase of 5.6 times that achievable by the 880 nm prior art LED beam used in an obscuration-type system. This is so because of the ability of blue light to detect submicron diameter smoke particles. Table 1 below shows for the obscuration-type system the increase in light intensity achievable with different decreasing wavelengths of light relative to that measured with the prior art 880 nm LED used in the obscuration-type system.

TABLE 1

System Response as a Function of Light Source Wavelength

| Light Source Wavelength | System Response: 880 nm LED System Response | |
|---|---|---|
| 880 nm | 1:1 | (100% of 880 nm LED system response) |
| 645 nm | 2.2:1 | (220% of 880 nm LED system response) |
| 570 nm | 3.8:1 | (380% of 880 nm LED system response) |
| 430 nm | 5.6:1 | (560% of 880 nm LED system response) |

Whether light of a particular wavelength is attenuated by smoke particles depends on their diameters but not their colors. Light beam 42 with a wavelength that is less than the diameters of the smoke particles will not be appreciably attenuated by them. Light source 40 emitting a 430 nm blue light beam 42 enables detection of smoke particles that are appreciably smaller than those detectable with the use of the 880 nm prior art infrared light beam. Smoke detector 10 implemented with a blue light source has, therefore, an improved ability to detect the submicron-diameter smoke particles produced in the early phases of a fire.

Exemplary preferred commercial light sources include the Infineon E63C-R2S2-1 and the Liteon LTST-C930CBKT, each of which having a light beam of ultra super blue light with a peak wavelength of 470 nm and having a clear lens.

Light detector 54 is preferably positioned directly adjacent first optical component 14, but may be positioned adjacent a lens assembly system (not shown) or second optical component 16. Exemplary preferred commercial light detectors include the Infineon BP-104S and SFH-2400, with sensing areas of 4 $mm^2$ and 1 $mm^2$, respectively.

Optical components 14 and 16 are preferably formed of molded plastic; however, alternative materials, including metal or glass, may be used. Optical components 14 and 16 are preferably of rectangular, square, spherical, elliptical, or parabolic overall shape and have curved or planar light reflecting surfaces as specified for their operational use. In the first preferred embodiment of FIG. 1, rectangular optical components 14 and 16 are molded together in a highly repeatable molding operation to create an integral unit with alignment reproducibility controlled by tooling.

In the first preferred embodiment of FIG. 1, light reflecting surfaces 18 and 20 are plastic surfaces coated with a metal reflective coating, but may be mirrors or mirror-backed lenses of preferably a round, radially symmetric type. Different ones of light reflecting surfaces 18 and 20 can be curved and flat, or both of them can be curved. An example of the latter configuration would be that each of light reflecting surfaces 18 and 20 is concave in shape and has a radius of curvature of 7.9 times the distance separating the apices of concave light reflecting surfaces 18 and 20. Light reflecting surfaces 18 and 20 are vertically positioned in smoke detector 10 when mounted so that the amount of dust or dirt settling on the light reflecting surfaces is minimized. Light reflecting surfaces 18 and 20 are positioned so that the surface normals at the apexes of the confronting concave surfaces are parallel to each other. Because relatively minor system vibrations may disrupt the parallel positioning of light reflecting surfaces 18 and 20, they are manufactured as an integral unit. Light reflecting surfaces 18 and 20 are sufficiently spaced apart from each other to limit spherical offset problems. Light reflecting surfaces 18 and 20 are spaced 70 mm apart; however, this distance will vary, depending on the spatial constraints of each individual smoke detector. It is preferable to have as much space as possible between light reflecting surfaces 18 and 20 while maintaining reliable sensitivity at a 2.5%/ft threshold.

In the first preferred embodiment of FIG. 1, openings 24 and 26 are located on the same optical component, i.e., optical component 14. Openings 24 and 26 are equidistantly spaced from optical axis 30 and spaced 5 mm apart from each other, measured from the center of opening 24 to the center of opening 26. Each opening is about 2 mm to about 3 mm in diameter, since the angle of acceptance of light source 40 is such that only the central 10 degrees of light emitted by light source 40 enters detection chamber 12, although the opening size will be dictated by the parameters of smoke detector 10. This is so because larger openings have the advantage of allowing more light into detection chamber 12 but the consequent disadvantage of allowing reflected light to escape from detection chamber 12.

Figure 3:
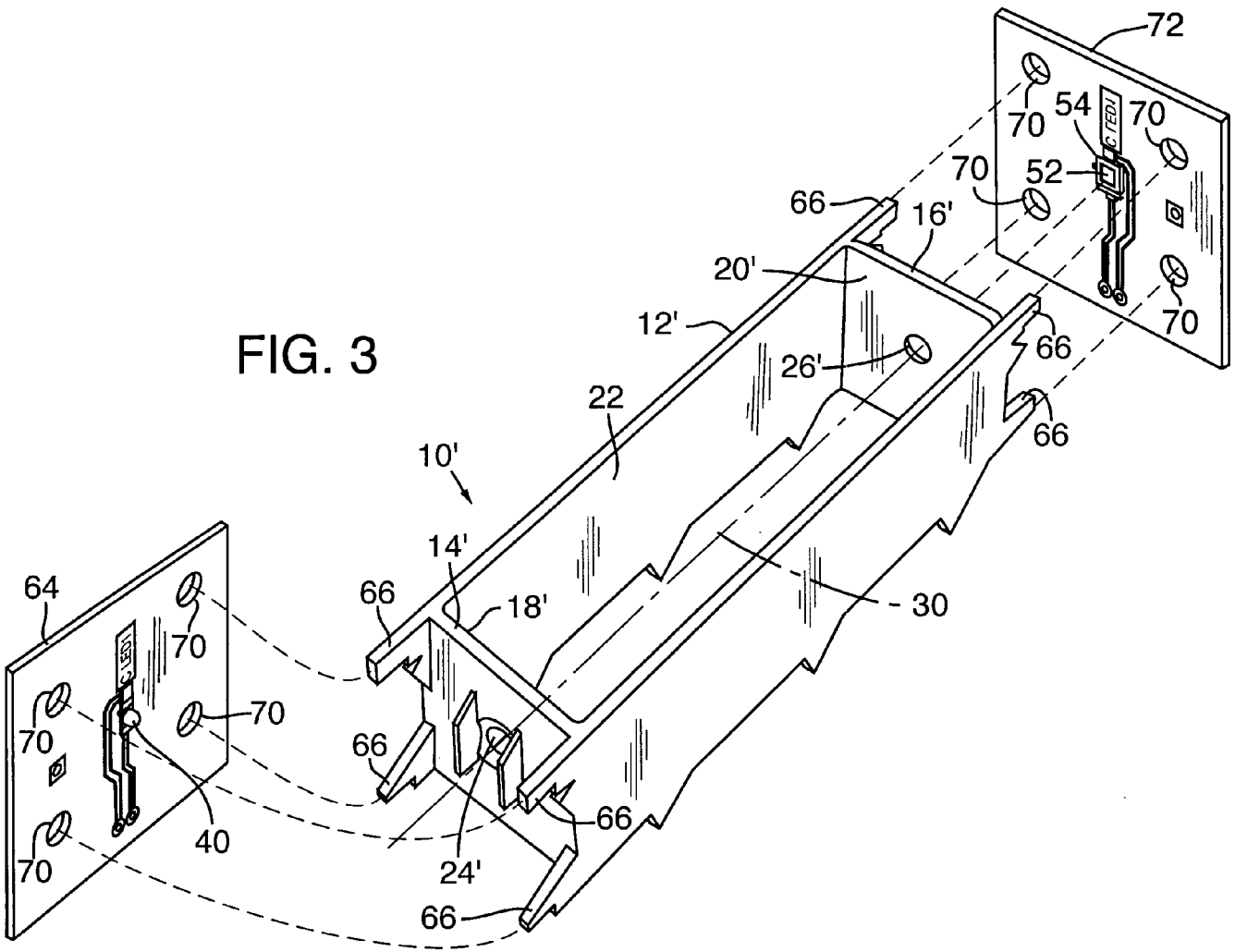
FIG. 3 is an exploded isometric view of a second embodiment of a smoke detector of the present invention in which a light source and a light detector are positioned adjacent different ones of two detection chamber light reflecting surfaces.

FIG. 3 shows a second preferred embodiment that differs from the first preferred embodiment of FIG. 1 in that a light source and a light detector are positioned adjacent different ones of two light reflecting surfaces of a detection chamber. Components corresponding to each other in FIGS. 1 and 3 have the same reference numerals followed by primes in FIG. 3. With reference to FIG. 3, a smoke detector 10' includes a detection chamber 12' in which light detector 54 is mounted on a circuit board 72 and is positioned adjacent second optical component 16', and light source 40 and light detector 54 lie on optical axis 30. If second optical component 16' is curved, light source 40 is preferably spaced from second optical component 16' a distance equal to its radius of curvature.

Figure 4A:
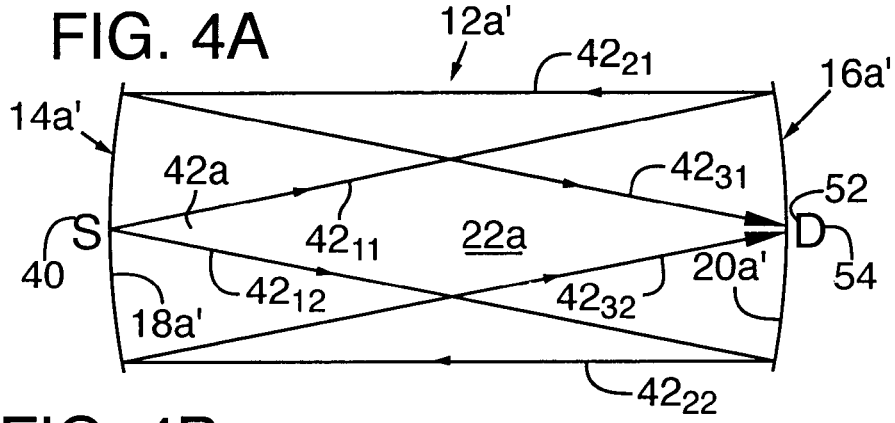
FIGS. 4A and 4B and FIGS. 4C and 4D are ray trace drawings representing the propagation paths and the effective path lengths of an exemplary light beam reflecting off of two light reflecting surfaces of the detection chambers of the smoke detectors of FIG. 3 and FIG. 1, respectively.
Figure 4B:
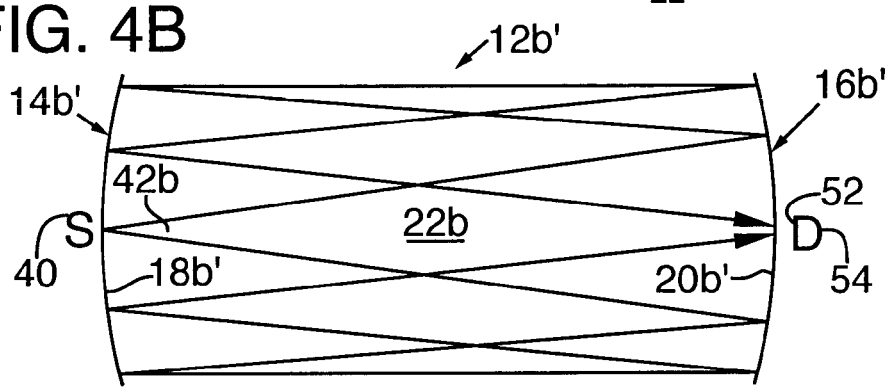
Figure 4C:
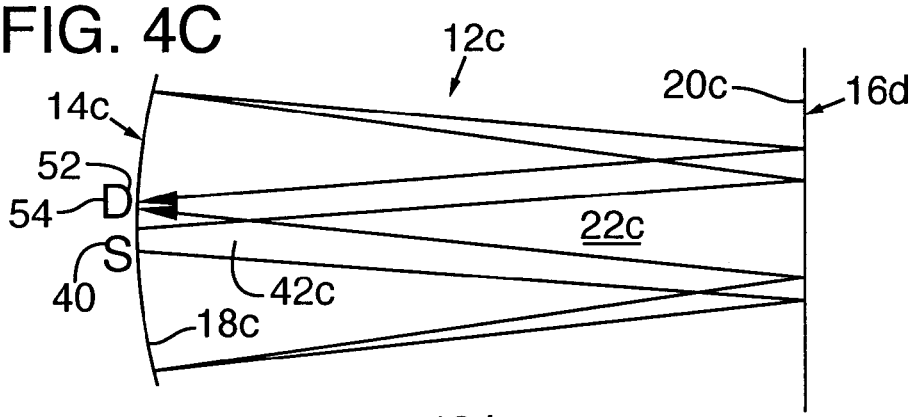
Figure 4D:
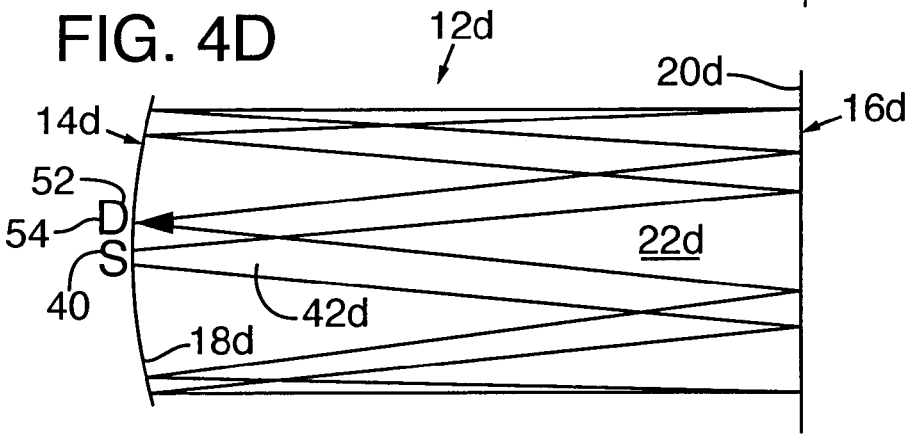

FIGS. 4A–4D are examples of four light reflecting surface configurations that provide a smoke detector with an increased effective path length. The path length of light beam 42 depends on the types and relative positioning of light reflecting surfaces of the optical components of detection chamber. FIGS. 4A and 4B show two implementations of smoke detector 10' of FIG. 3 with two curved detection chamber light reflecting surfaces, and FIGS. 4C and 4D show two implementations of smoke detector 10 of FIG. 1 with one plano and one curved detection chamber light reflecting surfaces. (Other light reflecting surface configurations can be implemented in accordance with the invention because the sensor and detector pair can be located at opposite ends or the same end of a detection chamber formed with one flat and one curved or two curved light reflecting surfaces.) Corresponding components of the different embodiments are identified by the same reference numeral followed by a lower case letter suffix that identifies the drawing figure in which an embodiment is depicted.

FIGS. 4A and 4B show detection chamber 12' implemented with two curved, preferably concave, optical components 14' and 16'. Light source 40 and light detector 54 are positioned on opposite sides of detection chamber 12', as shown in FIG. 3. Table 2 indicates by way of four examples that the number of times light beam 42 propagates across detection chamber 12 or 12' depends on the reflective properties of curved optical components 14 and 16 or 14' and 16', including their focal lengths and radii of curvature. In Table 2, FLRS and SLRS are acronyms for, respectively, first light reflecting surface and second light reflecting surface, and the radius of curvature of each FLRS and SLRS is expressed as a multiple of detection chamber length.

TABLE 2

Four Exemplary Smoke Detectors Having Two Curved Light Reflecting Surfaces

| Trips Across the Detection Chamber | Reflections off FLRS | Reflections off SLRS | FLRS Radius of Curvature | SLRS Radius of Curvature |
|---|---|---|---|---|
| 3 | 1 | 1 | 2X | 2X |
| 5 | 2 | 2 | 5.2X | 5.2X |
| 7 | 3 | 3 | 7.9X | 7.9X |
| 9 | 4 | 4 | 13.1X | 13.1X |

FIG. 4A is a diagram of a detection chamber 12*a'* that produces only two internal light beam reflections. Because it presents an uncluttered ray trace of light beam 42*a* as it propagates within detection chamber 12*a'*, FIG. 4A facilitates a description of the cooperation of light reflecting surfaces 18*a'* and 20*a'* in the operation of smoke detector 10'. Detection chamber 12*a'* includes curved, preferably concave, optical components 14*a'* and 16*a'* with spaced-apart respective light reflecting surfaces 18*a'* and 20*a'* of radii of curvature and focal lengths that cause three trips of light beam 42*a* across interior region 22*a* of detection chamber 12*a'*. Light source 40 and light detector 54 are positioned on opposite sides of detection chamber 12*a'* near optical component 14*a'* and optical component 16*a'*, respectively.

With reference to FIG. 4A, light beam 42*a* propagates through opening 24*a'* in optical component 14*a'* and expands in beam width such that, upon incidence on optical component 16*a'*, light beam 42*a* spreads across essentially the entire area of light reflecting surface 20*a'*. Light rays $\mathbf{42}_{11}$ and $\mathbf{42}_{12}$ define beam spread boundaries of light beam 42*a* during its first trip across detection chamber 12*a'*. Optical component 16*a'* collimates light beam 42*a* as it reflects off curved light reflecting surface 20*a'* and propagates back toward optical component 14*a'*. Light rays $\mathbf{42}_{21}$ and $\mathbf{42}_{22}$ define the beam spread boundaries of collimated light beam 42*a* during its second trip across detection chamber 12*a'*. Light beam 42*a* reflecting off curved light reflecting surface 18*a'* of optical component 14*a'* narrows in beam width such that, upon reaching optical component 16*a'*, light beam 42*a* propagates through opening 26*a'* and converges to a focus on light receiving surface 52 of light detector 54. Light rays $\mathbf{42}_{31}$ and $\mathbf{42}_{32}$ define the beam spread boundaries of light beam 42*a* during its third trip across detection chamber 12*a'*.

The radii of curvature and focal lengths of curved optical components 14*a'* and 16*a'* impart, therefore, to light beam 42*a* a pattern of broadening, collimating, and focusing such that light beam 42*a* is incident on light receiving surface 52 of light detector 54 after making three trips across detection chamber 12*a'*. Specifically, light beam 42*a* propagates through detection chamber 12*a'* and undergoes two reflections, one off of each of curved optical components 14*a'* and 16*a'*, before incidence on light detector 54.

FIG. 4B is a diagram of a second implementation of a detection chamber 12*b'* in which the radii of curvature and focal lengths of curved optical components 14*b'* and 16*b'* impart to light beam 42*b* a pattern of broadening, collimating, and focusing such that light beam 42*b* is incident on light receiving surface 52 of light detector 54 after making five trips across interior region 22*b* of detection chamber 12*b'*. Specifically, light beam 42*b* propagates through detection chamber 12*b'* and undergoes four reflections, two off of each of optical components 14*b'* and 16*b'*, before incidence on light detector 54.

FIGS. 4C and 4D show a detection chamber 12 implemented with a plano (flat) optical component 16 and a curved optical component 14 having a light reflecting surface 18 of spherical shape with the radius of curvature at the apex of curved optical component 14 normal to flat light reflecting surface 20 of flat optical component 16. Light source 40 and light detector 54 are positioned on the same side of detection chamber 12, as shown in FIG. 1. The positioning of flat optical component 16 relative to curved optical component 14 as described above imparts to light beam 42 a beam width that is sufficiently wide to render anomalous light reflections insignificant. The radius of curvature of curved optical component 14 imparts to light beam 42 a beam width that is sufficiently narrow to be substantially confined within the light sensitive area of light receiving surface 52 of light detector 54. Table 3 indicates by way of two examples that the reflective properties of curved optical component 18, such as focal length and radius of curvature, dictate the number of times light beam 42 propagates across detection chamber 12 before incidence on light detector 54. FLRS and SLRS have the same meanings and radius of curvature is expressed as the same measure as defined above with reference to Table 2.

TABLE 3

Two Exemplary Smoke Detectors Having One Plano and One Curved Light Reflecting Surfaces

| Trips Across the Detection Chamber | Reflections off FLRS | Reflections off SLRS | FLRS Radius of Curvature | SLRS Curvature |
|---|---|---|---|---|
| 4 | 1 | 2 | 2X | Flat |
| 6 | 2 | 3 | 4X | Flat |

FIG. 4C is a diagram of a first implementation of a detection chamber 12*c* in which the radius of curvature and focal length of curved optical component 14*c* impart to light beam 42*c* a pattern of collimating and focusing such that light beam 42*c* is incident on light receiving surface 52 of light detector 54 after making four trips across detection chamber 12*c*. Specifically, light beam 42*c* propagates through detection chamber 12*c* and undergoes three reflections, two off of flat optical component 16*c* and one off of curved optical component 14*c*, before incidence on light detector 54.

FIG. 4D is a diagram of a second implementation of a detection chamber 12*d*, in which flat optical component 16*d* and curved optical component 14*d* are aligned so that their respective light reflecting surfaces 20*d* and 18*d* are spaced 7 cm apart when the radius of curvature at the apex of curved optical component 14*d* is normal to light reflecting surface 20*d* of flat optical component 16*d*. Thus, curved optical component 14*d* preferably has a 28 cm radius of curvature and a 14 cm focal length. As shown in FIG. 4D, the radius of curvature and focal length of curved optical component 14*d* impart to light beam 42*d* a pattern of broadening, collimating, and focusing such that light beam 42*d* is incident on light receiving surface 52 of light detector 54 after making six trips across interior region 22*d* of detection chamber 12*d*. Specifically, light beam 42*d* propagates through detection chamber 12*d* and undergoes five reflections, three off of flat optical component 16*d* and two off of curved optical component 14*d*, before incidence on light detector 54. Because light beam 42*d* makes six trips between curved optical component 14*d* and flat optical component 16*d*, the effective path length of the light beam increases from 7 cm to 42 cm (from about 0.23 ft to about 1.38 ft). By increasing the effective path length, one can decrease the predetermined threshold level without increasing the incidence of false alarms. A further benefit of the smoke detector of FIG. 4D is that the brightness of the light beam that is incident on the light detector is substantially the same brightness as the light emitted by the light source.

Figure 5:
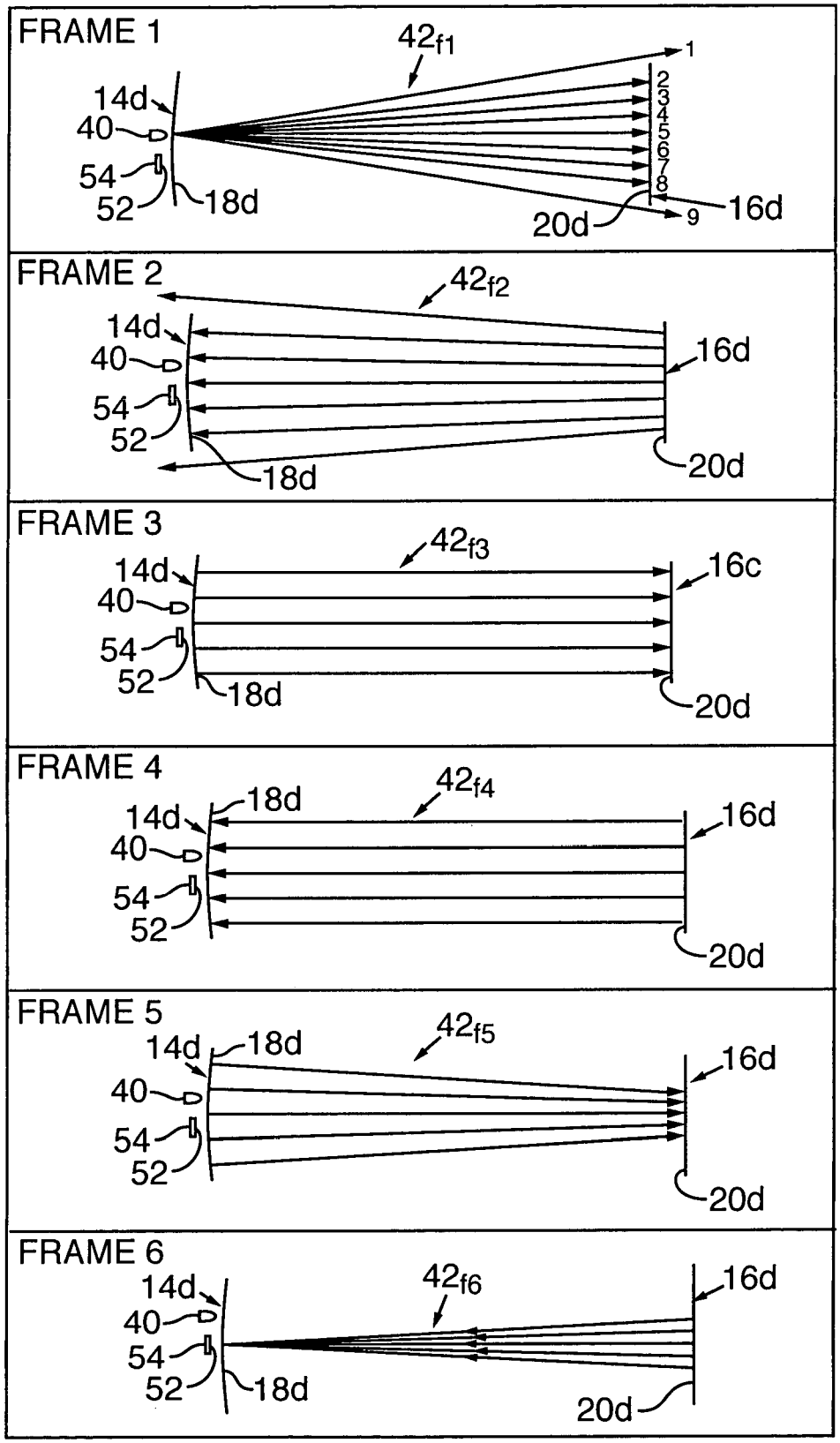
FIG. 5 shows in a series of six frames the sequential reflection of a fan of light rays off of the light reflecting surfaces shown in FIG. 4D.

FIG. 5 sets forth six frames showing the sequential reflection of nine exemplary light rays emitted by light source 40. The light rays are reflected off of light reflecting surfaces 18*d* and 20*d* contained within detection chamber 12*d* of FIG. 4D. (The order of light source 40 and light detector 54 is reversed in FIGS. 4D and 5 because the views they depict are taken from opposite sides of detection chamber 12*d*.)

Frame 1 shows a fan of light rays $\mathbf{42}_{f1}$ emitted by light source 40. The outermost light ray pair of the fan of light rays $\mathbf{42}_{f1}$ is not incident on light reflecting surface 20*d* and as a consequence escapes from detection chamber 12*d*. The remaining ones in the fan of light rays $\mathbf{42}_{f1}$ are incident on light reflecting surface 20*d*.

Frame 2 shows a fan of light rays $\mathbf{42}_{f2}$ reflected off of light reflecting surface 20*d*. Because light reflecting surface 20*d* is a flat optical component, the incident light rays $\mathbf{40}_{f1}$ are reflected as a fan of light rays $\mathbf{42}_{f2}$ such that their angles of reflection equal their respective angles of incidence. Thus, the fan of reflected light rays $\mathbf{42}_{f2}$ occupies a sufficient portion of interior region 22*d* of detection chamber 12*d* to render anomalous light reflections insignificant, thereby decreasing the number of hot spots and dust-related system disruption. Frame 2 shows that the width of the fan of reflected light rays $\mathbf{42}_{f2}$ is so large that the outermost light ray pair is not incident on light reflecting surface 18*d* and as a consequence escapes from detection chamber 12*d*.

Frame 3 shows a fan of light rays $\mathbf{42}_{f3}$ reflected off of light reflecting surface 18*d*. Light reflecting surface 18*d* is a curved optical component having a radius of curvature that causes incident light rays $\mathbf{42}_{f2}$ to be reflected as a fan of light rays $\mathbf{425}_{f3}$ imaged at infinity. Thus, incident light rays $\mathbf{42}_{f2}$ propagate away from light reflecting surface 18*d* as a collimated fan of light rays.

Frame 4 shows a fan of light rays $\mathbf{42}_{f4}$ reflected off of light reflecting surface 20*d*. Because light reflecting surface 20*d* is a flat optical component, the incident light rays $\mathbf{42}_{f3}$ imaged at infinity are reflected as a fan of light rays $\mathbf{42}_{f4}$ also imaged at infinity and thus propagate away from light reflecting surface 20*d* as a collimated fan of light rays.

Frame 5 shows a fan of light rays $\mathbf{42}_{f5}$ reflected off of light reflecting surface 18*d*. The focal length and radius of curvature of light reflecting surface 18*d* dictates the angles at which the incident light rays $\mathbf{42}_{f5}$ are reflected. In detection chamber 12*d*, the incident light rays $\mathbf{42}_{f4}$ are reflected as a fan of light rays $\mathbf{42}_{f5}$ of progressively narrowing fan width as they propagate toward light reflecting surface 16*d*.

Frame 6 shows a fan of light rays $\mathbf{42}_{f6}$ reflected off of light reflecting surface 20*d*. Because light reflecting surface 20*d* is a flat optical component, the incident light rays $\mathbf{42}_{f5}$ are reflected as a fan of light rays $\mathbf{42}_{f6}$ such that their angles of reflection equal their respective angles of incidence. Thus, the width of the fan of light rays $\mathbf{42}_{f6}$ further narrows following their reflection off of light reflecting surface 20*d*. The width of the fan of light rays $\mathbf{42}_{f6}$ reaching opening 26*d* in curved optical component 14*d* is sufficiently narrow that a significant number of the light rays $\mathbf{42}_{f6}$ are incident on light receiving surface 52 of light detector 54.

Table 4 demonstrates for six additional exemplary smoke detectors with a sensitivity of 3.3%/ft and implemented with two light reflecting surfaces and a blue light source the relationship between effective path length and alarm threshold level. (The 3.3%/ft sensitivity threshold for blue light is equivalent to a 2.0%/ft sensitivity threshold for yellow light, which is the industry standard test source used by Underwriters Limited.) Table 4 indicates that the greater the effective path length, the lower the threshold level (the magnitude of light obscuration measured by light detector 54 sufficient to activate an alarm). Lowering the threshold level reduces the incidence of false alarms.

TABLE 4

Effective Path Lengths of Six Exemplary Smoke Detectors

| Effective Path Length (cm) | Spatial Region (mm) | Threshold Level (%) |
|---|---|---|
| 2.54 (1 ft) | 50.8 | 96.66% |
| 3.12 (1.23 ft) | 62.5 | 95.91% |
| 3.50 (1.38 ft) | 70 | 95.4% |
| 3.81 (1.50 ft) | 76.2 | 95.0% |
| 4.62 (1.82 ft) | 92.4 | 94.0% |
| 5.00 (1.97 ft) | 100 | 93.5% |

A third preferred embodiment of the smoke detector of the present invention shown in FIGS. 6A, 6B, 6C, and 6D includes two light sources that emit light of different wavelengths. This embodiment, which is beneficial for analytical measurements in confined areas, such as in a smoke stack, includes an infra-red light source and a blue light source to detect different types of fire. If the purpose is to detect gas absorption, the infrared light source preferably emits far infrared light; and if the purpose is to detect smoke, the infrared light source preferably emits near infrared light.

FIGS. 6A, 6B, 6C, and 6D are isometric views of four implementations of the third preferred embodiment, in which two light sources and two light detectors are positioned adjacent light reflecting surfaces of a single detection chamber. The third embodiment is described in greater detail with reference to the implementation of FIG. 6A and in lesser detail with reference to each of the implementations of FIGS. 6B, 6C, and 6D.

Figure 6A:
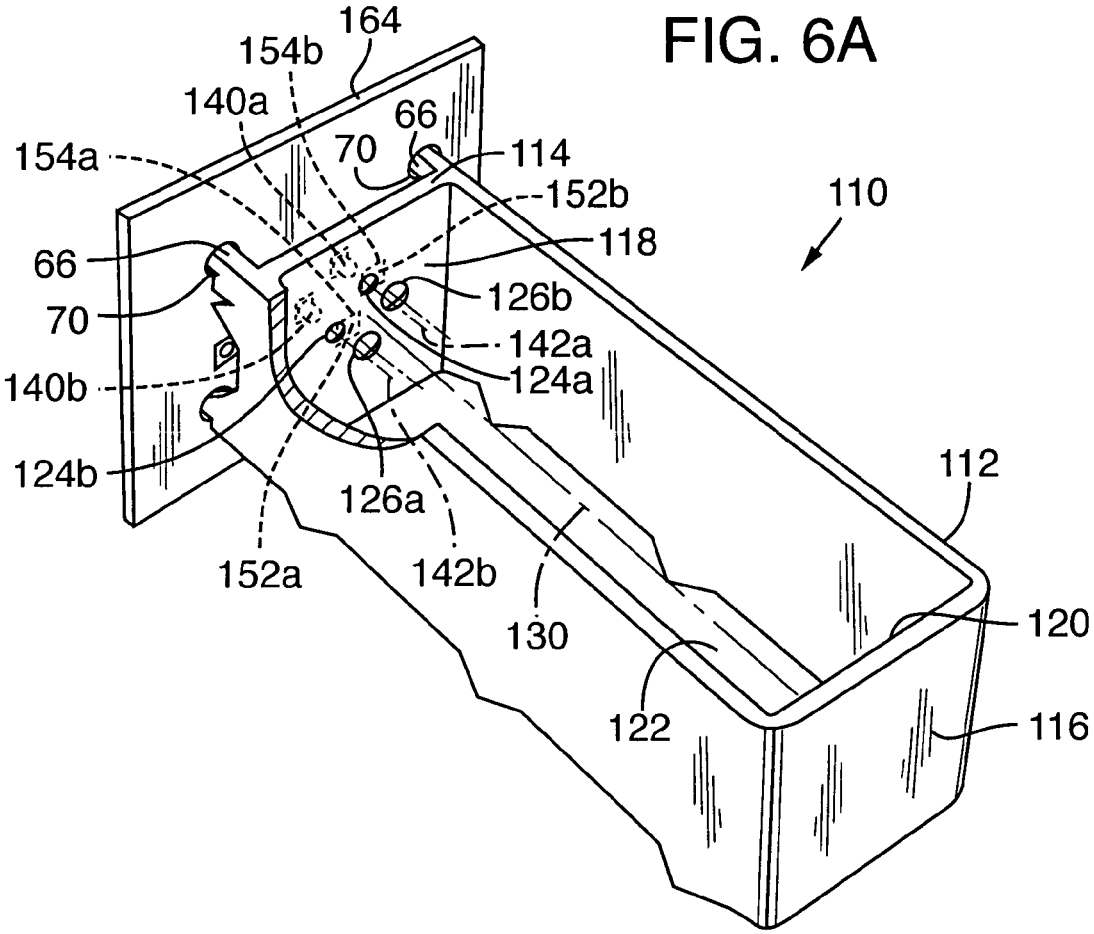
FIGS. 6A, 6B, 6C, and 6D are isometric views of four implementations of a third preferred embodiment of a smoke detector of the present invention in which two light sources and two light detectors are positioned adjacent light reflecting surfaces of the same detection chamber.

FIG. 6A shows an implementation in which the two light sources and the two light detectors are positioned adjacent the same light reflecting surface. With reference to FIG. 6A, a dual light source smoke detector 110 includes a detection chamber 112 that is of similar configuration to that of detection chamber 12 of FIG. 1, with the exception that detection chamber 112 receives light from and delivers light to, respectively, two light sources and two light detectors. Detection chamber 112 is formed of first and second optical components 114 and 116 having respective light reflecting surfaces 118 and 120 that are spaced apart to create an interior spatial region 122 through which air carrying smoke particles can pass. Optical component 114 has first and second openings 124*a* and 124*b* through different ones of which two light beams can enter detection chamber 112, and first and second openings 126*a* and 126*b*, through different ones of which two light beams can exit detection chamber 112. The centers of openings 124*a*, 124*b*, 126*a*, and 126*b* are positioned in quadrature relationship about an optical axis 130 such that openings 124*a* and 126*a* are aligned along a first coordinate axis and openings 124*b* and 126*b* are aligned along a second coordinate axis that is orthogonal to the first coordinate axis.

Light sources 140*a* and 140*b* and light detectors 154*a* and 154*b* are mounted on a circuit board 164 that is affixed to detection chamber 112 in the manner described above with reference to smoke detector 10. Light sources 140*a* and 140*b* are placed on circuit board 164 for axial alignment with the respective apertures 124*a* and 124*b* in optical component 114. Light receiving surface 152*a* of light detector 154*a* and light receiving surface 152*b* of light detector 154*b* are placed on circuit board 164 for axial alignment with, respectively, apertures 126*a* and 126*b* of optical component 114. A first light beam 142*a* propagating from light source 140*a* enters detection chamber 112 through aperture 124*a* and exits detection chamber 112 through aperture 126*a* for incidence on light receiving surface 152*a* of light detector 154*a*. A second light beam 142*b* propagating from light source 140*b* enters detection chamber 112 through aperture 124*b* and exits detection chamber 112 through aperture 126*b* for incidence on light receiving surface 152*b* of light detector 154*b*. The placement of light source 140*a* and its associated light detector 152*a* on opposite sides of optical axis 130 and of light source 140*b* and its associated light detector 152*b* on opposite sides of optical axis 130 is intended to reduce occurrences of light propagating from a light source and incident on a light detector with which the light source is not associated.

Dual light source smoke detector 110 has the benefit of using only two light reflecting surfaces, and thereby limiting manufacturing costs. The presence of four openings in light reflecting surface 118 increases, however, the amount of light escaping from the detection chamber and thereby decreases the brightness and intensity the light beams incident on the light detectors.

Figure 6B:
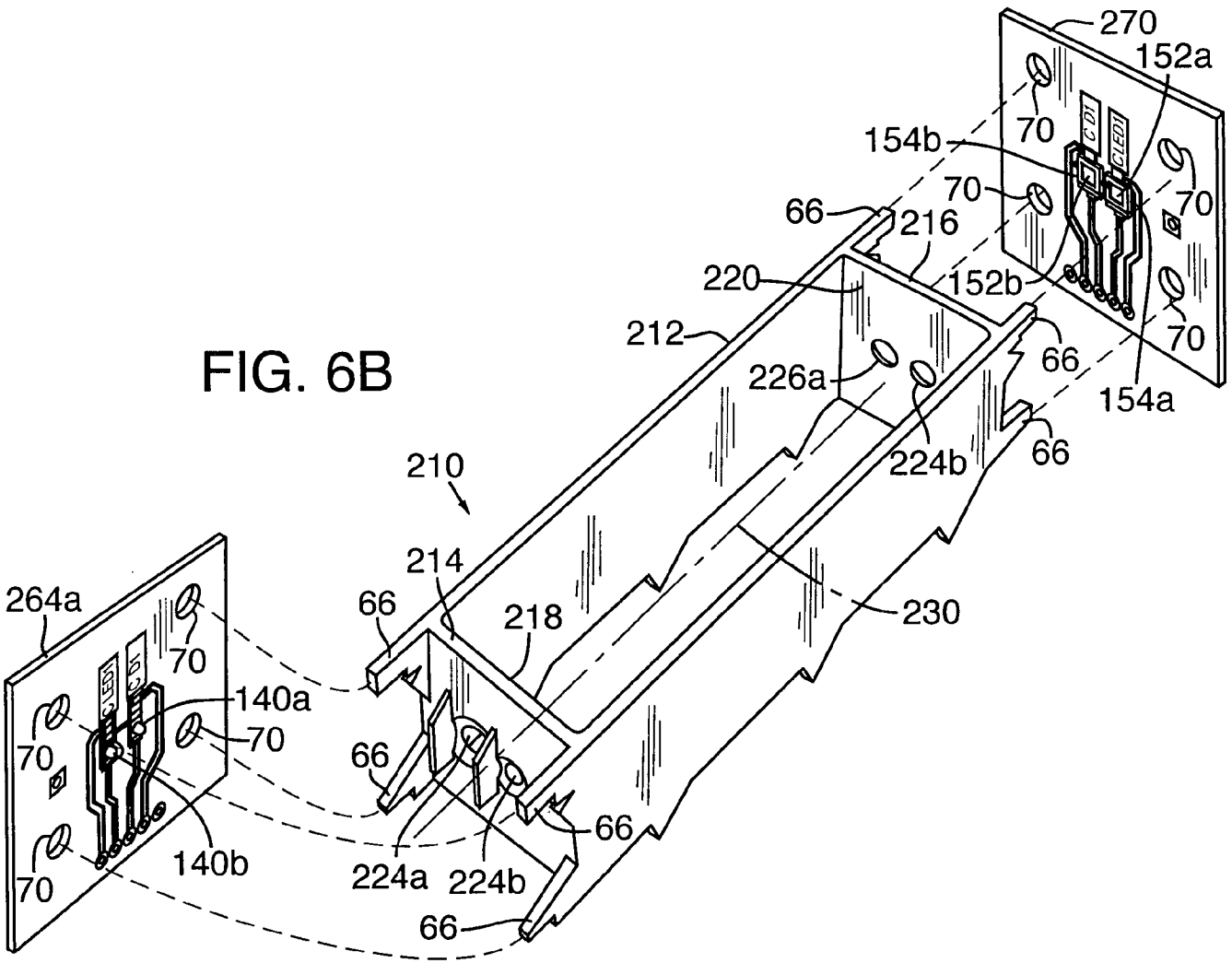

FIG. 6B shows a dual light source smoke detector implementation 210 in which the two light sources are positioned adjacent one light reflecting surface and the two light detectors are positioned adjacent the other light reflecting surface. With reference to FIG. 6B, first light source 140*a* and second light source 140*b* are positioned adjacent light reflecting surface 218, and first light detector 154*a* and second light detector 154*b* are positioned adjacent light reflecting surface 220. Light emitted by light sources 140*a* and 140*b* is incident on their associated light detectors 154*a* and 154*b*, respectively. Light emitted by each light source is reflected across detection chamber 212 an odd number of times before incidence on the light detector with which the light source is associated.

Figure 6C:
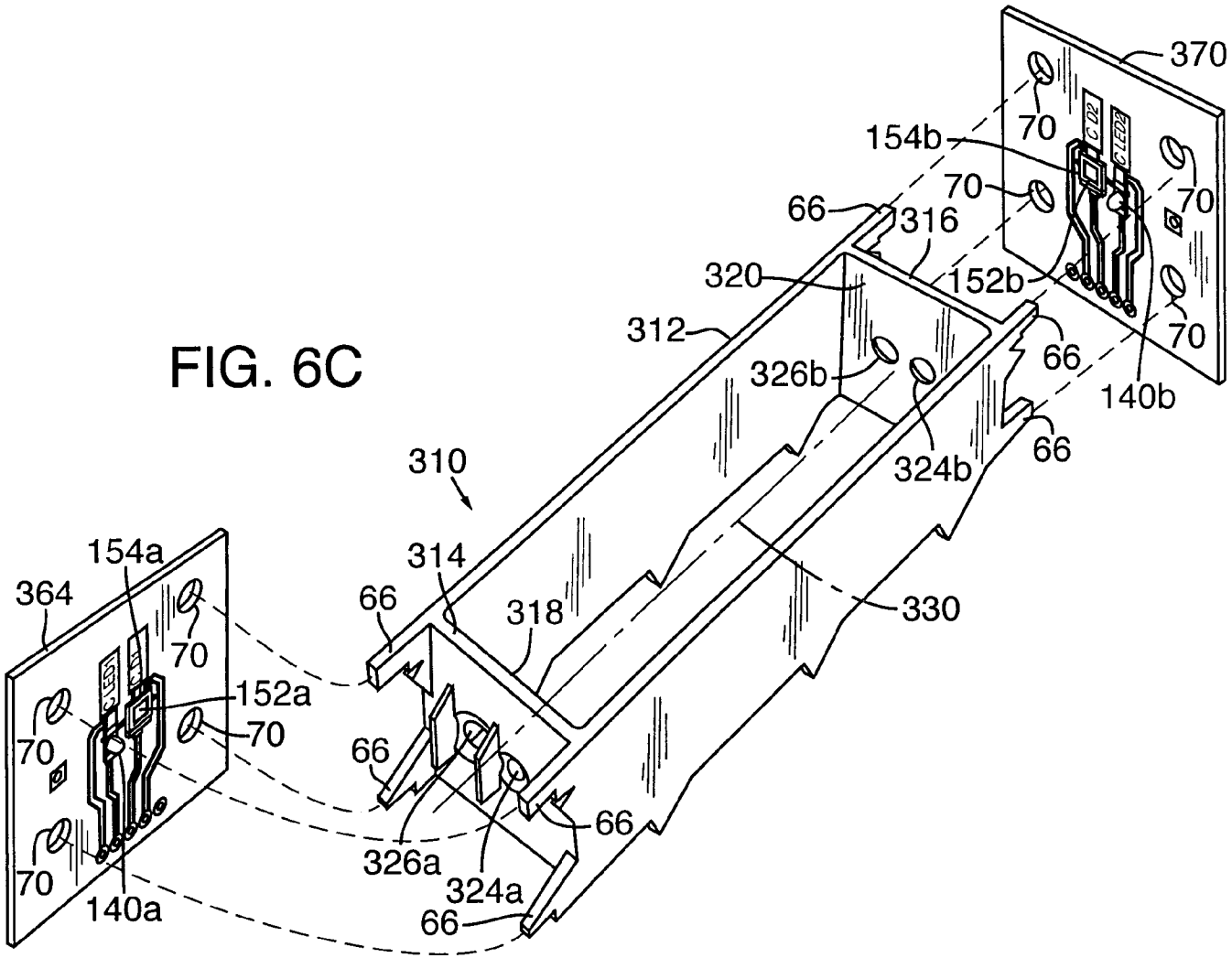

FIG. 6C shows a dual light source smoke detector implementation 310 in which different light source and associated light detector pairs are positioned adjacent the two light reflecting surfaces. With reference to FIG. 6C, first light source 140*a* and its associated first light detector 154*a* are positioned adjacent light reflecting surface 318, and second light source 140*b* and its associated second light detector 154*b* are positioned adjacent light reflecting surface 320. Light emitted by each light source is reflected across detection chamber 312 an even number of times before incidence on the light detector with which the light source is associated.

Figure 6D:
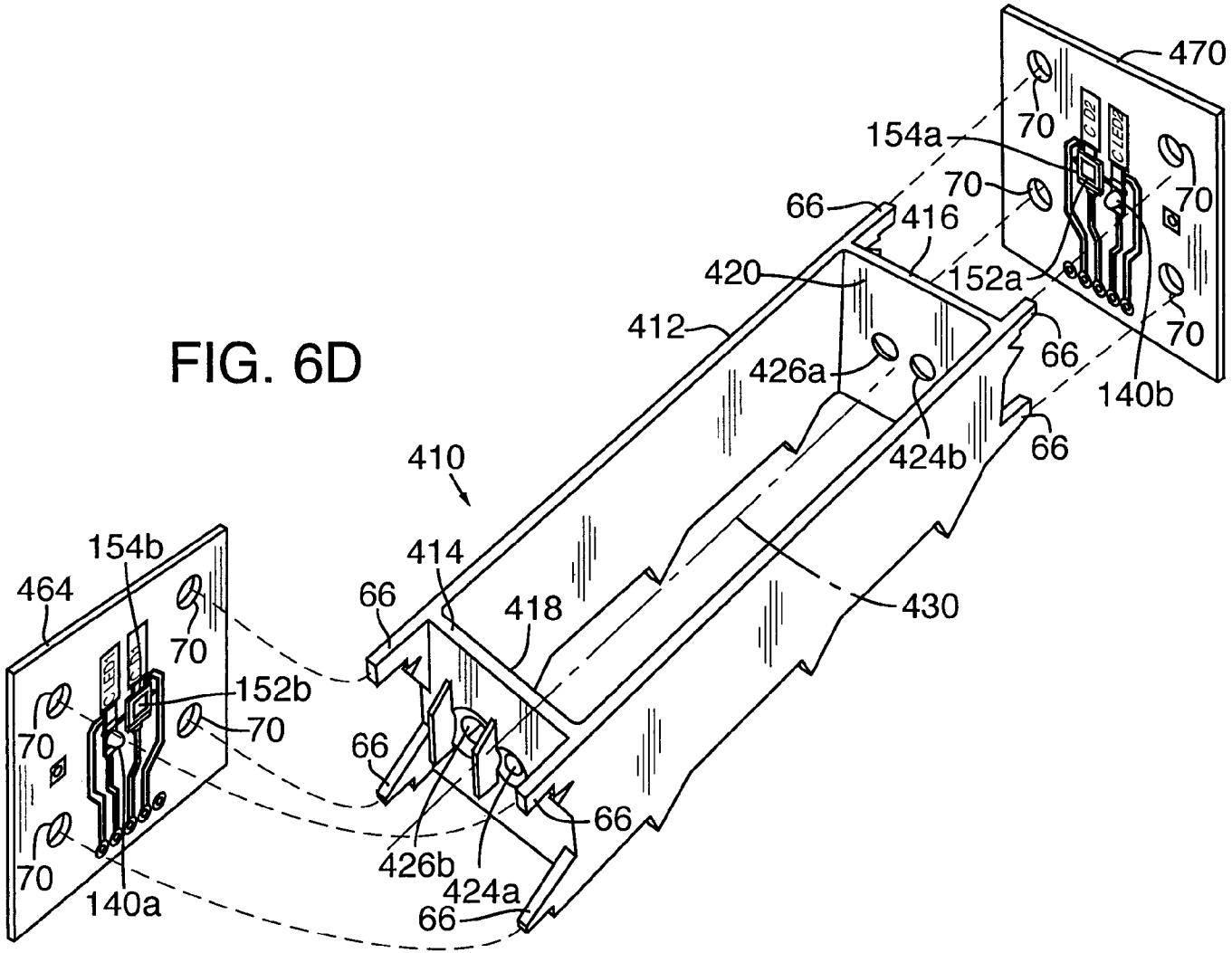

FIG. 6D shows dual light source smoke detector implementation 410 in which different light source and nonassociated light detector pairs are positioned adjacent the two light reflecting surfaces. With reference to FIG. 6D, first light source 140*a* and second light detector 154*b*, which is associated with light source 140*b*, are positioned adjacent light reflecting surface 418, and second light source 140*b* and first light detector 154*a*, which is associated with light source 140*a*, are positioned adjacent light reflecting surface 420. Light emitted by each light source is reflected across detection chamber 412 an odd number of times before incidence on the light detector with which the light source is associated.

Figure 6E:
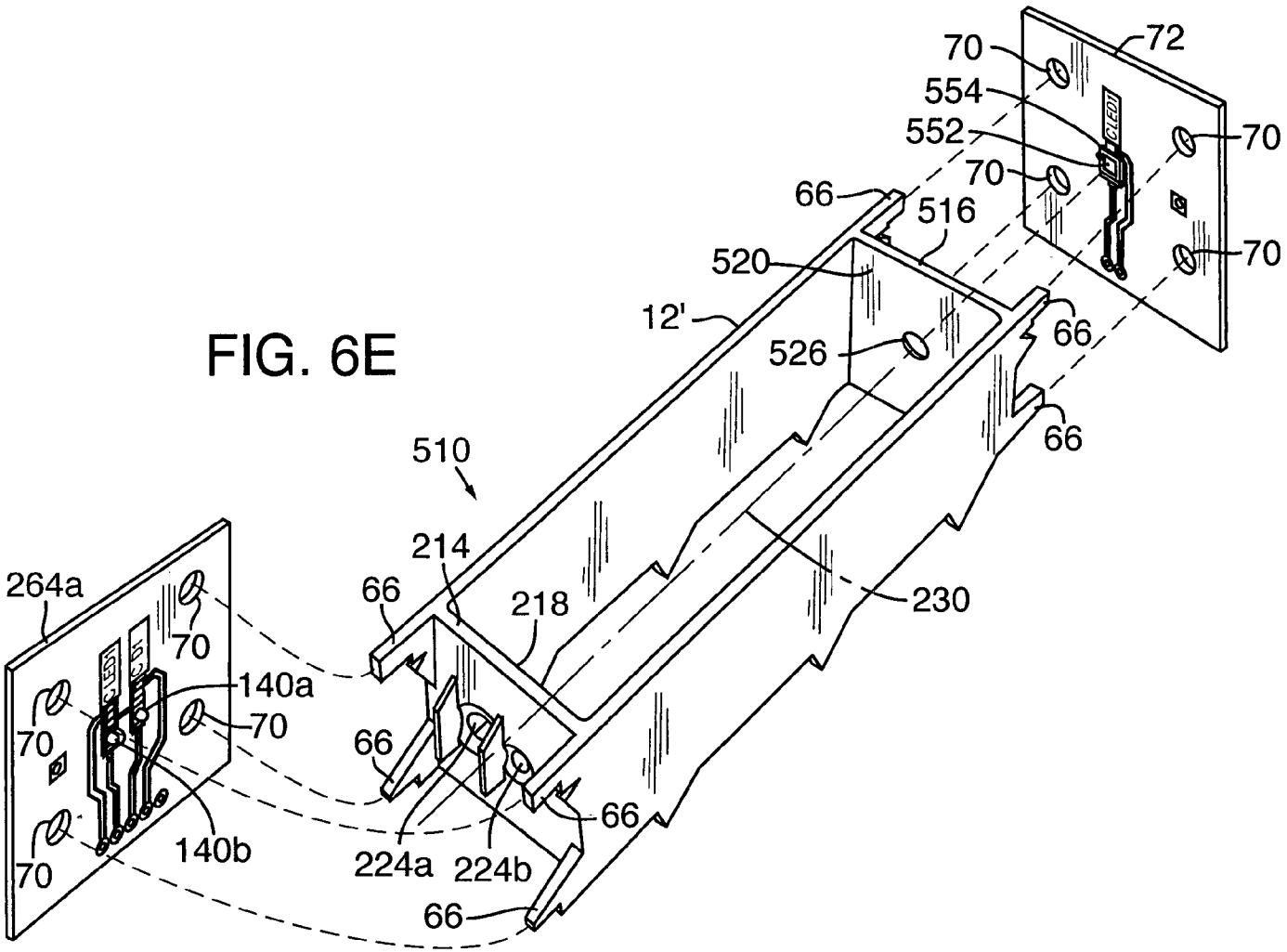
FIG. 6E is an isometric view of a smoke detector in which two light sources and a single light detector are positioned adjacent different light reflecting surfaces of the same detection chamber.

FIG. 6E is an isometric view of a fifth implementation of the third embodiment, in which two light sources are positioned adjacent one light reflecting surface and a single, wideband light detector is positioned adjacent the other light reflecting surface. Smoke detector implementation 510 of FIG. 6E is similar to smoke detector implementation 210 of FIG. 6B, differing in that only one light detector 554 receives light emitted by first light source 140*a* and second light source 140*b* and propagating through a single opening 526 in an optical component 516. Lenslets (not shown) optically associated with light sources 140*a* and 140*b* direct the light emitted by them through opening 526 for incidence on light receiving surface 552 of light detector 554.

Figure 6F:
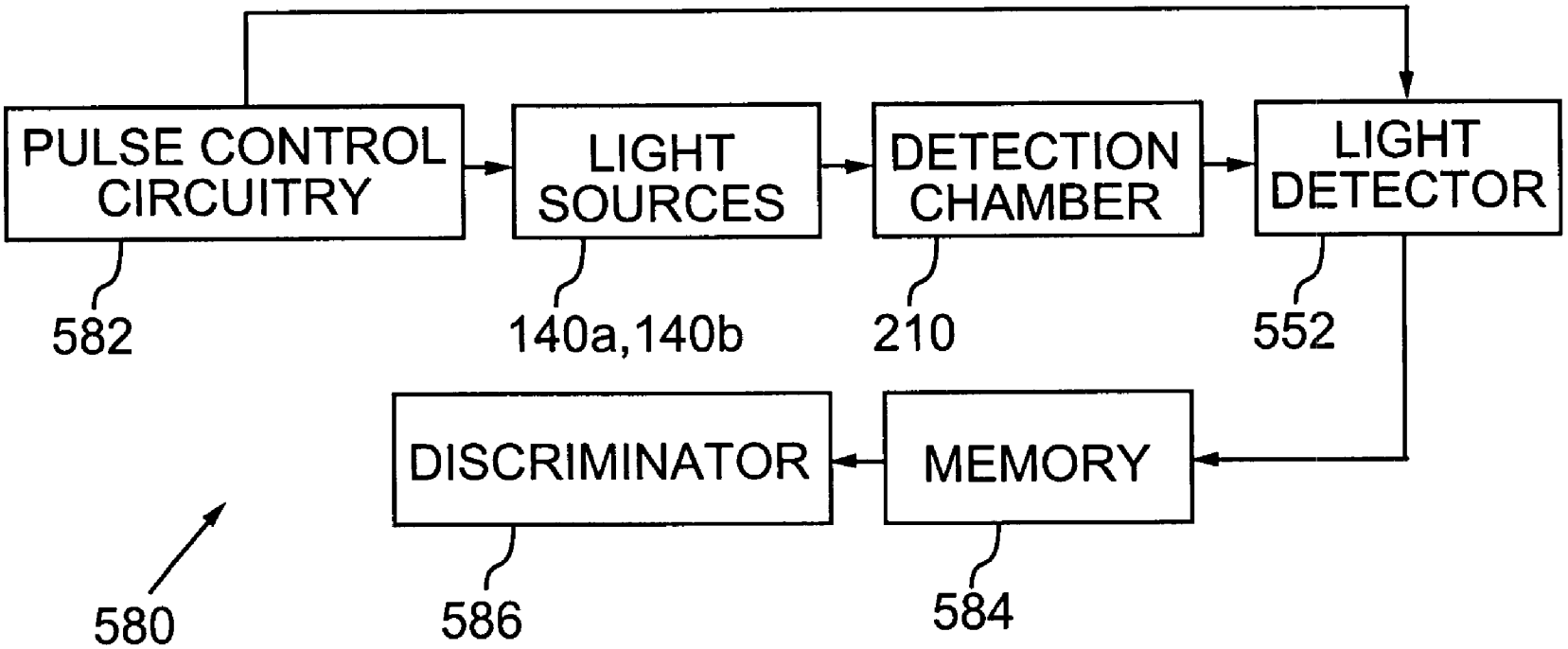
FIG. 6F is a block diagram of smoke sample acquisition control circuitry that controls the operation of the light sources and light detector or detectors associated with the detection chambers of FIGS. 6A–6E to produce output signals indicative of sizes of smoke particles present in one of the detection chambers.

FIG. 6F is a block diagram of smoke sample acquisition control circuitry 580 that controls the operation of light sources 140*a* and 140*b* and light detector 554 of smoke detector implementation 510 of FIG. 6E. With reference to FIG. 6F, pulse circuitry 582 causes alternate light emissions from first light source 140*a* and second light source 140*b* and concurrent measurement of the corresponding light intensity incident on light receiving surface 552 of light detector 554. The measured light intensity values are recorded in memory storage sites 584. Thus, the operational process of acquiring light intensity values entails pulse control circuit 582 causing light source 140*a* to emit light pulses and light detector 554 to measure the pulsed light intensity incident on light receiving surface 552, and then causing light source 140*b* to emit light pulses and light detector 554 to measure the pulsed light intensity incident on light receiving surface 552. A discriminator 586 receives the acquired and recorded light intensity values of the light beams of different wavelengths and determines from them average sizes of the gas-borne particles present between light reflecting surfaces 218 and 520.

There are three general categories of smoke particle sizes that contribute to the average sizes of smoke particles present between the light reflecting surfaces. The three categories include smaller particles such as those produced by flaming fire, larger particles such as water vapor and dust particles, and mid-sized particles such as smoldering smoke particles or a mixture of the smaller and larger particles. Discriminator 586 distinguishes, therefore, the gas-borne particles from one another by their origins as indicated by their particle sizes.

Skilled persons will appreciate that smoke sample acquisition control circuitry 580 can be adapted to determine sizes of particles present in the other smoke detector embodiments, in which there are either a single light source and a single light detector or multiple light sources and multiple light detectors. Such adaptation would entail either elimination or modification of the operation of pulse control circuitry 582, depending on the number of light sources and extent of sharing of the components used.

Figure 7:
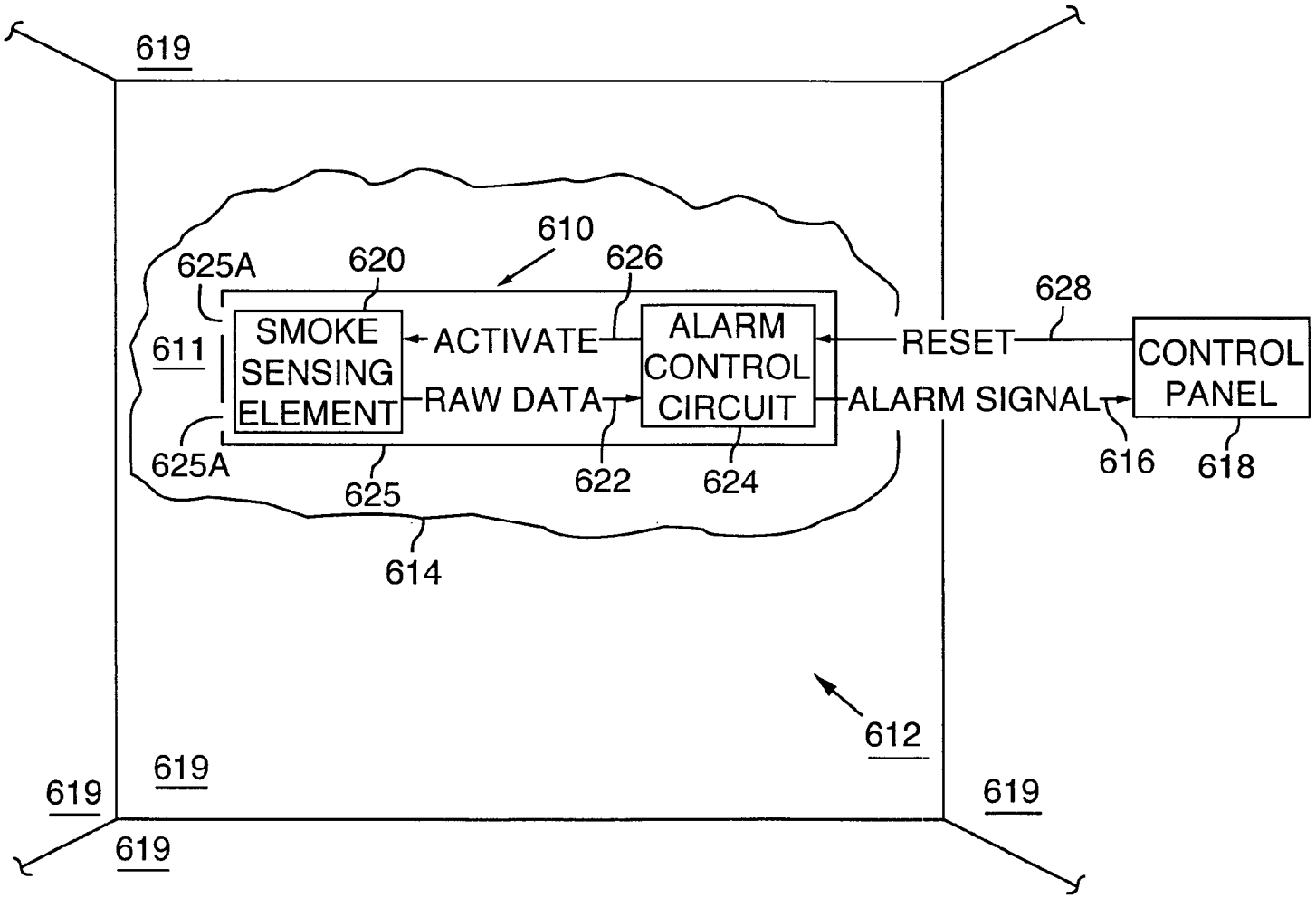
FIG. 7 is a schematic block diagram showing connected to a control panel a self-adjusting smoke detector with self-diagnosing capabilities.

FIG. 7 is a block diagram of a smoke detector 610 having self-adjustment and self-diagnostic capabilities. With reference to FIG. 7, self-contained smoke detector 610 is used to determine whether at a spot 611 in a confined spatial region 612 being monitored there is a sufficiently high level of smoke (e.g., in ambient air at spot 611) that an alarm condition should be signaled by producing an alarm signal on a signal path 616 to a control unit or panel 618. Region 612 may but need not be at least partly confined by surfaces 619. Smoke detector 610 includes a smoke sensing element 620 that measures the smoke level at spot 611 and provides over a signal path 622 to an alarm control circuit 624 a sensing element signal or raw data, i.e., data that have not yet been adjusted as described below, indicative of that smoke level. Smoke sensing element 620 and alarm control circuit 624 are each mounted on a discrete housing 625 that operatively couples smoke sensing element 620 to region 612 and that mounts smoke sensing element 620 and alarm control circuit 624 at spot 611. Housing 625 may, but need not, incorporate a replaceable canopy, e.g., the replaceable canopy of the smoke detector described in U.S. Pat. No. 5,546,074. Housing 625 may have openings 625A that admit ambient air 614 with any associated smoke for measurement by smoke sensing element 620. Smoke sensing element 620 includes an LED-light source 40 and a photodiode light detector 54, the latter of which detects light not attenuated by smoke particles as described above with reference to FIGS. 4A–4D and 5. Alarm control circuit 624 controls activation of smoke sensing element 620 over signal path 626. Control panel 618 resets alarm control circuit 624 over signal path 628.

Figure 8:
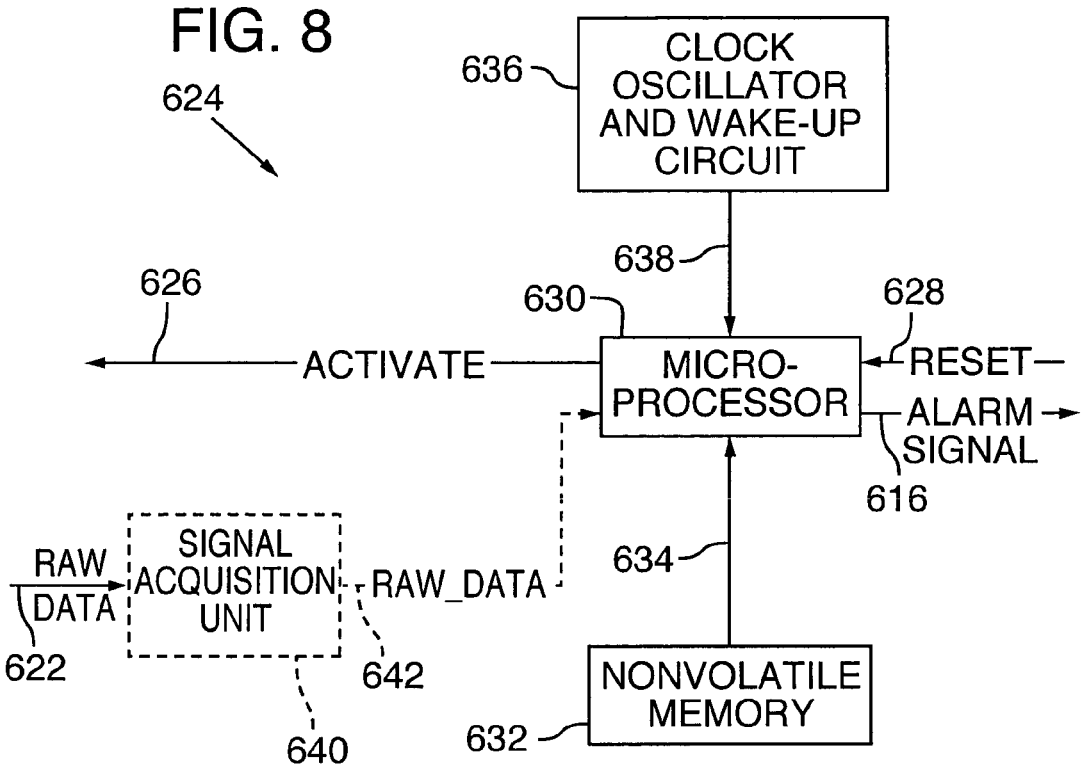
FIG. 8 is a schematic block diagram of an alarm control circuit shown in FIG. 7.

FIG. 8 is a schematic block diagram showing details of alarm control circuit 624. Circuit 624 includes a processor or microprocessor 630, to which are connected a nonvolatile memory 632, e.g., an electrically erasable programmable read-only memory, over a signal path 634 and a clock oscillator and wake-up circuit 636 over a signal path 638. An instruction set for microprocessor 630 is contained in read-only memory internal to microprocessor 630. Memory 632 holds certain operating parameters described below that are determined during calibration. Raw data from smoke sensing element 620 may lead over signal path 622 to an optional signal acquisition unit 640, which converts or conditions the raw data, which are, e.g., analog data, into a digital form RAW_DATA and then conveys that digital form over a signal path 642 to microprocessor 630. Signal acquisition unit 640 includes an analog-to-digital ("A/D") converter, described below with reference to FIGS. 11 and 12, to convert the analog output of the photodiode to digital form. If smoke sensing element 620 produces its raw data output in a form, whether analog or digital, that microprocessor 630 can receive directly, then signal path 622 may convey that raw data directly to the microprocessor, which produces from that raw data the digital representation RAW_DATA on which it operates.

To reduce the power requirements of smoke detector 610, microprocessor 630 is preferably inactive or "asleep" except when it is periodically "awakened." Clock oscillator and wake-up circuit 636 may, depending on the microprocessor selected, be internal or external to microprocessor 630. Also to reduce power requirements, microprocessor 630 activates smoke sensing element 620 over signal path 626 to sample the smoke level in region 612 (FIG. 7). However, any form of sampling that produces samples of the output of smoke sensing element 620 at appropriate times is adequate. The sampling produces successive samples, each indicative of a smoke level at a respective one of successive sampling times. Microprocessor 630 is reset over signal path 628 by control panel 618 (FIG. 7).

Figure 9:
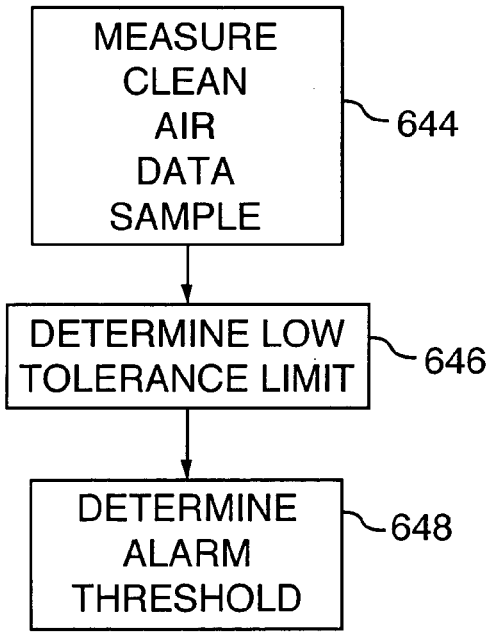
FIG. 9 is a flow diagram showing steps performed in the factory during calibration of the smoke detector of FIG. 7.

The self-adjustment and self-diagnostic capabilities of smoke detector 610 depend on calibrating the sensor electronics and storing certain parameters in memory 632. FIG. 9 is a flow diagram showing the calibration steps performed in the factory. Process block 644 indicates the measurement in an environment known to be free of smoke of a clean air signal or clean air data sample CLEAN_AIR that represents a 0% smoke level. The clean air voltage of the photodiode operational amplifier is a relatively high voltage. Process block 646 indicates a determination of a low tolerance limit, which is used in self-diagnosis and is set well below CLEAN_AIR.

Process block 648 indicates the determination of an alarm threshold that corresponds to an output of smoke sensing element 620 which indicates the presence of excessive smoke in region 612 and in response to which an alarm condition should be signaled. The alarm threshold is set as a percentage value of CLEAN_AIR. The ability to set the alarm threshold without the use of a simulated smoke environment representing a calibrated level of smoke is an advantage over prior art light scattering systems.

Upon conclusion of the calibration process, the output of smoke sensing element 620 and any signal acquisition unit 640 is calibrated, and values for CLEAN_AIR, the low tolerance limit, and the alarm threshold are stored in memory 632. The first two of those values are specific to the individual smoke detector 610 that was calibrated, and the third value, alarm threshold, is a simple factor of CLEAN_AIR. Also stored in memory 632 are values for a slew limit and ADJISENS, the use of which is described below.

Figure 10:
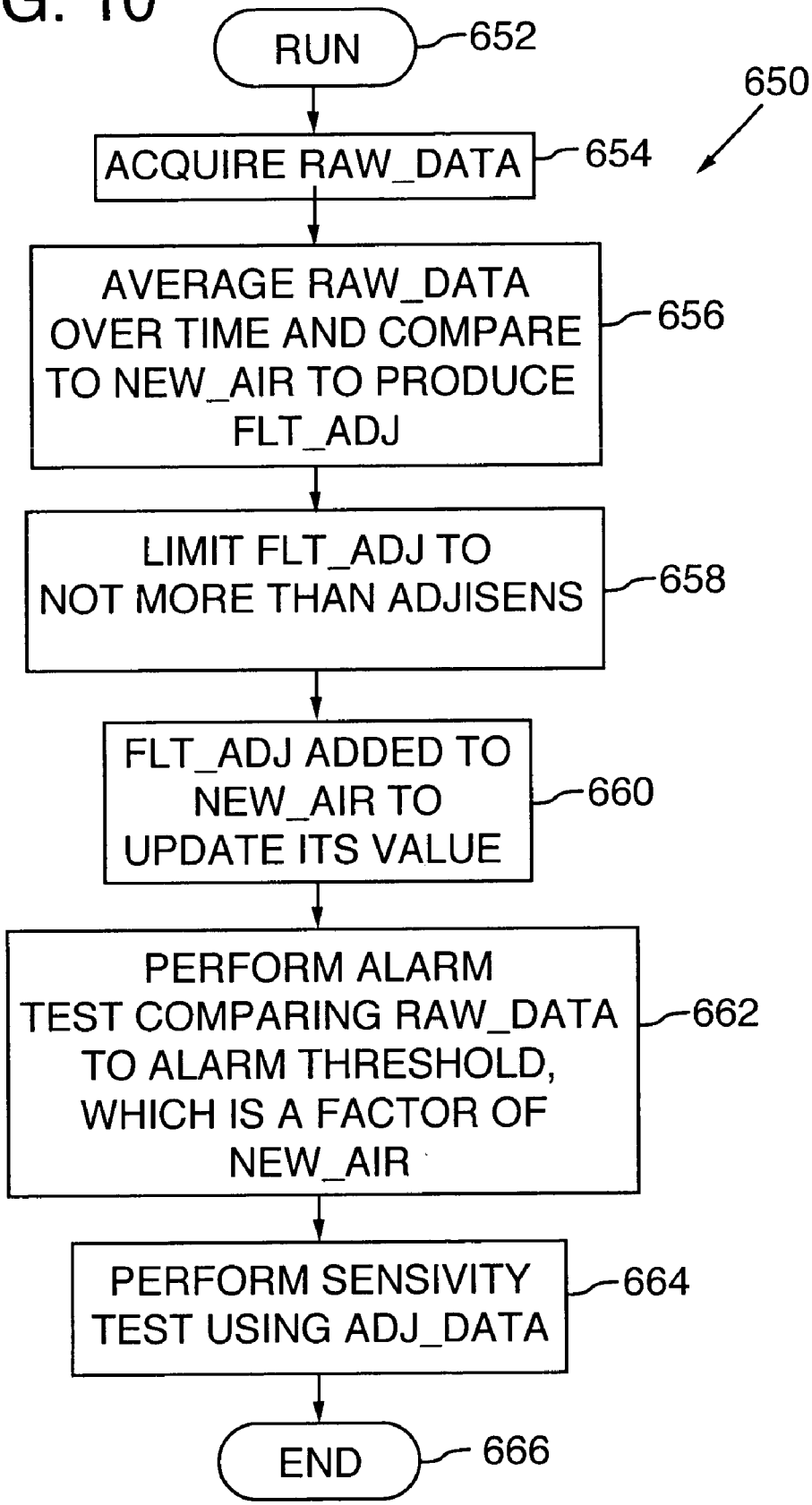
FIG. 10 is a flow diagram summarizing steps executed by a microprocessor shown in FIG. 8 in performing self-adjustment, determining whether an alarm condition exists, and carrying out self-diagnosis.

The self-adjustment and self-diagnostic features of the invention as implemented in the algorithm described in connection with FIG. 10 are premised on the assumption that there is a constant ratio between the measured percent of light obscuration at the output of smoke sensing element 620 and the level of smoke. That relationship can be expressed as $$O=r*S,$$

where O represents the measured percent of light obscuration, r represents the fixed ratio that is a result of the path length and wavelength of the light beam, and S represents the actual level expressed as percent-per-foot obscuration of smoke present in the chamber.

The measured percent obscuration is determined by the following formula $$O=1-M/NA,$$

where O is as defined above, M represents the measured output of smoke sensing element 620 when smoke is present, and NA represents the measured output of smoke sensing element 620 when clean air is present at the time of the measurement. The equation is unaffected by a build-up of dust or other contaminants. If dust, contamination, degradation of the light source, or a change in sensor sensitivity over time causes a reduction of measured output in clean air, the measured output when smoke is present will, therefore, be reduced by the same factor.

A change in contamination or degradation in the sensing chamber over time causes smoke sensing element 620 to produce, in conditions in which smoke indicative of an alarm condition is not present (NA), an output different from CLEAN_AIR. Whenever the output of smoke sensing element 620 in such conditions falls below the clean air voltage measured at calibration, smoke detector 610 becomes more sensitive in that it will produce an alarm signal when the smoke level falls below the level to which the alarm threshold was set. This can cause unnecessary production of the alarm signal.

Because there is, even with changes over time, a direct correlation between a change in output voltage for NA and a change in output voltage for M, the invention exploits that correlation by using certain changes over time in the output of smoke sensing element 620 as a basis for adjusting for change of CLEAN_AIR to maintain smoke detector 610 with the sensitivity with which it was calibrated.

The self-adjustment process that microprocessor 630 executes is designed to correct, within certain limits, for changes in sensitivity of smoke detector 610 while retaining the effectiveness of smoke detector 610 for detecting fires. The self-adjustment process rests on the fact that a change in the output of smoke sensing element 620 over a data gathering time interval that is long in comparison to the smoldering time of a slow fire in region 612 usually results from, not a fire, but a change in sensitivity of the system. Microprocessor 630 uses such a change as a basis for determining a floating adjustment FLT_ADJ that is used to adjust the original recorded CLEAN_AIR level to create a NEW_AIR level, which functions as a close approximation of NA. ADJ_DATA, which is the total difference between CLEAN_AIR and NEW_AIR, is then also used for self-diagnosis.

FIG. 10 is a flow diagram showing an algorithm or routine 650 implemented in microprocessor 630 to carry out the self-adjustment, alarm test, and self-diagnosis features of the invention. Microprocessor 630 receives the successive signal samples produced by smoke sensing element 620 and uses those samples for three purposes.

First, microprocessor 630 determines successive floating adjustments or values of FLT_ADJ with use of the sensing element signal or RAW_DATA produced during a corresponding one of successive data gathering time intervals or 24-hour periods (FIG. 10, process blocks 654, 656). Each data gathering time interval extends a data gathering duration or 24 hours. Each floating adjustment is indicative at least in part of relationships between RAW_DATA in the 24-hour period and NEW_AIR. Typically the value of FLT_ADJ, or at least the trend from one value of FLT_ADJ to the next succeeding value, is generally indicative of whether RAW_DATA is lower than NEW_AIR in the corresponding 24-hour period in the preferred embodiment FLT_ADJ is (after initialization) updated once every 24 hours on the basis of selected samples produced in those 24 hours.

Second, microprocessor 630 determines, at successive smoke level determination times (FIG. 10, process blocks 656, 660, and 662) whether the output of sensing element 620 or RAW_DATA indicates an excessive level of smoke at spot 611 in region 612. It does so with use of an alarm threshold that is set as a factor of NEW_AIR, the sensing element signal, and one of the NEW_AIR floating adjustments that corresponds to the smoke level determination time. The corresponding one of the floating adjustments used has as its data gathering time interval one that is sufficiently recent to the smoke level determination time that the sensing element signal in the absence of smoke is unlikely to have changed significantly from the data gathering time interval to that smoke level determination time. In a preferred embodiment, the value of FLT_ADJ is typically, used immediately after the 24-hour period, which is the typical data gathering time interval for that value of FLT_ADJ. During such a 24-hour time span, it is unlikely that the response of sensing element 620 in the absence of smoke would change significantly in typical regions 612. In principle, a value of FLT_ADJ that was produced on the basis of a data gathering time interval much more than 24 hours before (even a year before) that value of FLT_ADJ is used at a smoke level determination time could produce acceptable results for some regions 612. Whether a data gathering time interval is sufficiently recent to a smoke level determination time for a floating adjustment determined on the basis of that data gathering time interval to be used at that smoke level determination time depends on, e.g., the rapidity of significant change in the sensing element signal in the absence of smoke and the desired degree of fidelity of FLT_ADJ at that smoke level determination time.

Third, microprocessor 630 determines, with use of a determination of an excessive level of smoke, whether to signal the existence of an alarm condition by activating its alarm signal over signal path 616. Microprocessor 630 activates its alarm signal only when it has determined that RAW_DATA exceeds the alarm threshold for a predetermined time or for a predetermined number of or three consecutive signal samples. Such confirmation of an alarm condition provides a major advantage over conventional smoke detectors and smoke detector systems. Every false alarm places firefighters' lives at risk in traveling to the scene of the false alarm, decreases firefighters' ability to respond to genuine alarms, and imposes unnecessary costs. The choice of the predetermined time or of the predetermined number of consecutive signal samples entails balancing the need for prompt signaling of a true alarm condition against the need to avoid false alarms.

With reference to FIG. 10, microprocessor 630 executes routine 650 once every 9 seconds (except at power-up or reset, when it executes routine 650 once every 1.5 seconds for the first four executions), entering those steps at RUN block 652.

The two process blocks 656 and 658 indicate processes that microprocessor 630 performs only at selected times. To conserve code in a practical implementation, conditions controlling entry into process block 656 may be tested even in executions of routine 650 in which such processes are not to be carried out, and process block 658 may be carried out in each execution of routine 650 even though it has the potential to affect the value of FLT_ADJ only in executions in which FLT_ADJ is changed. Process block 658 indicates that microprocessor 630 then limits the maximum value of FLT_ADJ to not more than a predetermined low limit ADJISENS. ADJISENS limits the extent to which smoke detector 610 will self-correct for insensitivity. ADJISENS is chosen in conjunction with the tolerance limits so that slow, smoldering fires will not adjust NEW_AIR sufficiently to alter the actual clean air reference so that smoke detector 610 is still operable to detect fires reliably. ADJISENS corresponds to a change in smoke obscuration level of about 0.5%/ft (or smaller) in the digital word FLT_ADJ. ADJISENS is set so that smoke detector 610 does not automatically produce an alarm signal at power-up or reset in the initialization process described below.

As indicated by process block 662, microprocessor 630 then performs an alarm test comparing RAW_DATA with the alarm threshold value established during calibration as a preset factor of NEW_AIR, and stored in memory 632 and activates the alarm signal when RAW_DATA equals or is less than the alarm threshold value for three consecutive signal samples or as described above. Then, as indicated by process block 664, microprocessor 630 uses ADJ_DATA to perform a self-diagnostic sensitivity test to determine whether to signal that smoke detector 610 is sufficiently out of adjustment to require service. When that task is complete, microprocessor 630 ends that execution of routine 650, as indicated by END block 666.

Figure 11:
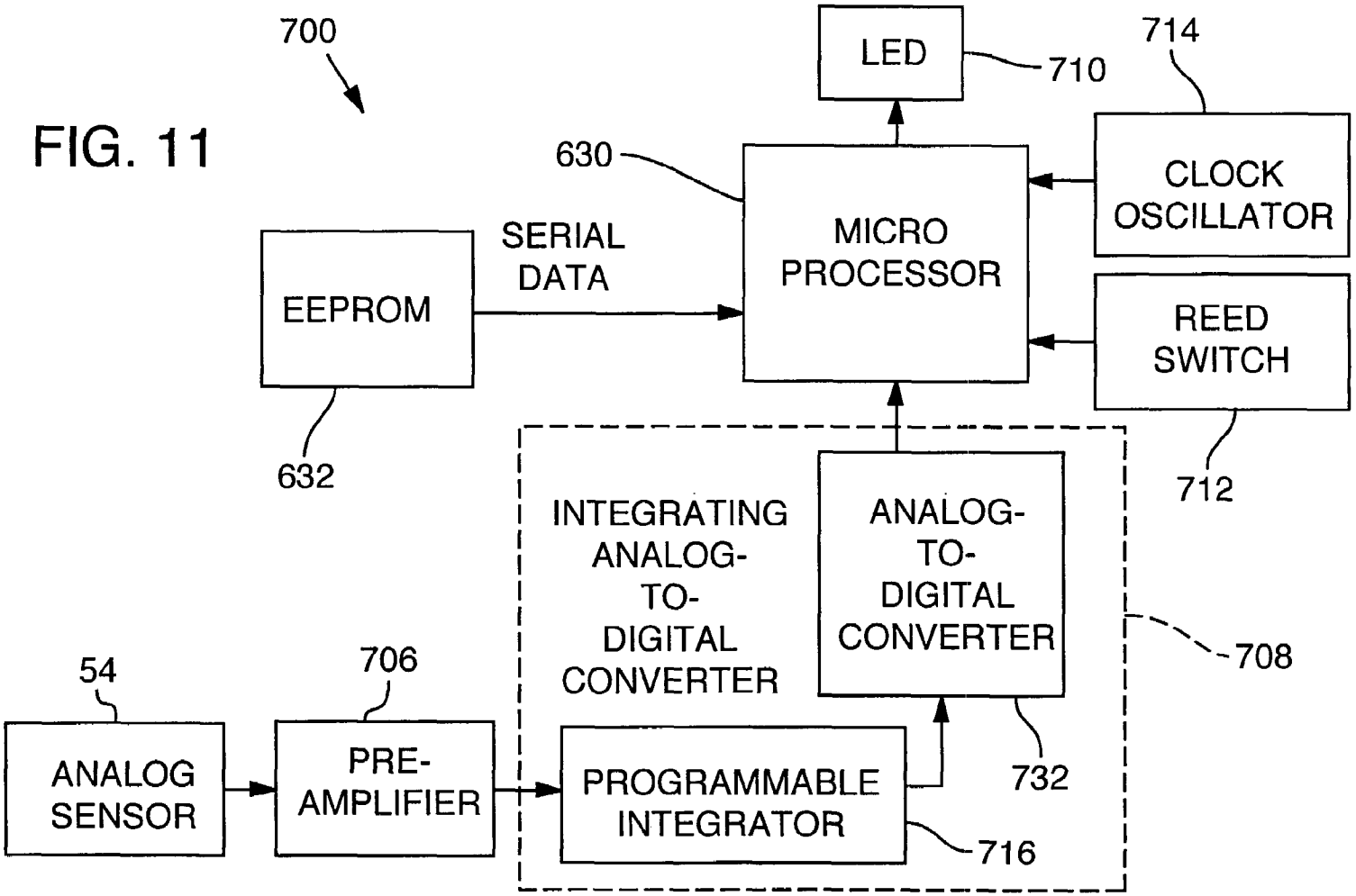
FIG. 11 is a general block diagram of the microprocessor-based circuit that implements the self-diagnostic and calibration functions of the smoke detector of FIG. 7.

FIG. 11 is a general block diagram of a microprocessor-based circuit 700 in which the self-diagnostic functions of the smoke detector system are implemented. The operation of circuit 700 is controlled by microprocessor 630 that periodically applies electrical power to photodiode 54, which is a part of smoke sensing element 620, to sample the amount of smoke present. Periodic sampling of the output voltage of photodiode 54 reduces electrical power consumption. In a preferred embodiment, the output of photodiode 54 is sampled for 0.4 millisecond every nine seconds. Microprocessor 630 processes the output voltage samples of photodiode 54 in accordance with instructions stored in EEPROM 632 to determine whether an alarm condition exists or whether the optical electronics are within preassigned operational tolerances.

Each of the output voltage samples of photodiode 54 is delivered through a sensor preamplifier 706 to a variable integrating analog-to-digital converter subcircuit 708. Converter subcircuit 708 takes an output voltage sample and integrates it during an integration time interval set during the alarm threshold calibration step discussed with reference to process block 648 of FIG. 9. Upon conclusion of each integration time interval, subcircuit 708 converts to a digital value the analog voltage representative of the photodiode output voltage sample taken.

Microprocessor 630 receives and as described above adjusts the digital values of ADJ_DATA and NEW_AIR. Microprocessor 630 then compares these values to the alarm voltage and sensitivity tolerance limit voltage established and stored in EEPROM 632 during calibration. The process of adjusting the integrator voltages presented by subcircuit 708 is carried out by microprocessor 630 in accordance with an algorithm implemented as instructions stored in EEPROM 632. The processing steps of this algorithm have been described above with reference to FIG. 10. Microprocessor 630 causes continuous illumination of a visible light-emitting diode (LED) 710 to indicate an alarm condition and performs a manually operated self-diagnosis test in response to an operator's activation of a reed switch 712. A clock oscillator 714, which is a part of clock oscillator and wake-up circuit 636, having a preferred output frequency of 500 kHz provides the timing standard for the overall operation of circuit 700.

Figure 12:
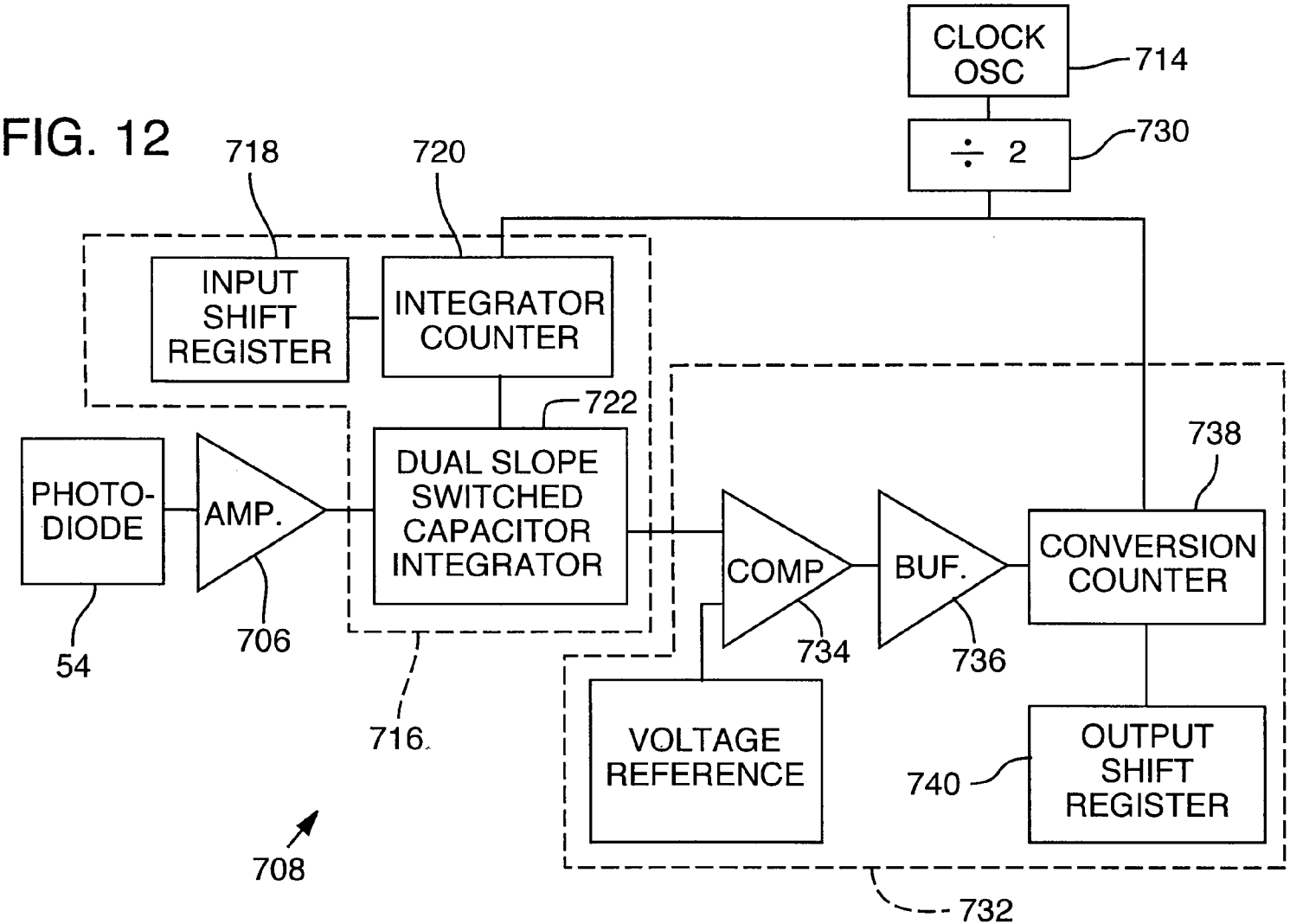
FIG. 12 is a block diagram showing in greater detail the variable integrating analog-to-digital converter shown in FIG. 11.

FIG. 12 shows in greater detail the components of variable integrating analog-to-digital converter subcircuit 708. The following is a description of operation of converter subcircuit 708 with particular focus on the processing it carries out during calibration to determine the integration time interval.

With reference to FIGS. 11 and 12, preamplifier 706 conditions the output voltage samples of photodetector 54 and delivers them to a programmable integrator 716 that includes an input shift register 718, an integrator up-counter 720, and a dual-slope switched capacitor integrator 722. During each 0.4 millisecond sampling period, an input capacitor of integrator 722 accumulates the voltage appearing across the output of preamplifier 706. Integrator 722 then transfers the sample voltage acquired by the input capacitor to an output capacitor.

At the start of each integration time interval, shift register 718 receives under control of microprocessor 630 an 8-bit serial digital word representing the integration time interval. The least significant bit corresponds to 9 millivolts, with 2.3 volts representing the full scale voltage for the 8-bit word. Shift register 718 provides as a preset to integrator up-counter 720 the complement of the integration time interval word. A 250 kHz clock produced at the output of a divide-by-two counter 730 driven by 500 kHz clock oscillator 714 causes integrator up-counter 720 to count up to zero from the complemented integration time interval word. The time during which up-counter 720 counts defines the integration time interval during which integrator 722 accumulates across an output capacitor an analog voltage representative of the photodetector output voltage sample acquired by the input capacitor. The value of the analog voltage stored across the output capacitor is determined by the output voltage of photodiode 54 and the number of counts stored in integrator counter 720.

Upon completion of the integration time interval, integrator up-counter 720 stops counting at zero. An analog-to-digital converter 732 then converts to a digital value the analog voltage stored across the output capacitor of integrator 722. Analog-to-digital converter 732 includes a comparator amplifier 734 that receives at its noninverting input the integrator voltage across the output capacitor and at its inverting input a reference voltage, which in the preferred embodiment is 300 millivolts, a system virtual ground. A comparator buffer amplifier 736 conditions the output of comparator 734 and provides a count enable signal to a conversion up-counter 738, which begins counting up after integrator up-counter 720 stops counting at zero and continues to count up as long as the count enable signal is present.

During analog to digital conversion, integrator 722 discharges the voltage across the output capacitor to a third capacitor while conversion up-counter 738 continues to count. Such counting continues until the integrator voltage across the output capacitor discharges below the +300 millivolt threshold of comparator 734, thereby causing the removal of the count enable signal. The contents of conversion up-counter 738 are then shifted to an output shift register 740, which provides to microprocessor 30 an 8-bit serial digital word representative of the integrator voltage for processing in accordance with the mode of operation of the smoke detector system. Such modes of operation include the previously described in-service self-diagnosis, calibration, and self-test.

During calibration, the smoke detector system determines the measured sensor output in clean air to establish CLEAN_AIR, which is stored in EEPROM 632. As indicated by process block 648 of FIG. 9, the preferred 2.5%/ft obscuration alarm threshold level is established as a factor of NEW_AIR and stored in EEPROM 632. Because different photodiodes 54 differ somewhat in their output voltages, determining the integration time interval that produces an integrator voltage equal to the alarm voltage sets the CLEAN_AIR reference of the system. Thus, different counting time intervals for integrator up-counter 720 produce different integrator voltages stored in shift register 740.

A smoke detector having self-diagnostic and self-adjustment capabilities can be constructed to have an extended, cleaning maintenance-free operational life. Such a smoke detector, which is described below with reference to smoke detector 610, is implemented with a high precision floating background adjustment and optionally with synchronous detection.

The high precision floating background adjustment is accomplished by substituting a 10-bit A/D converter for the A/D converter included in signal acquisition unit 640 and performing 10-bit processing of RAW_DATA. The additional two bits provides a four-fold increase in drift compensation precision capability and thereby extends the smoke detector lifetime during which no cleaning need be performed.

Synchronous detection entails causing microprocessor 630 to activate smoke sensing element 620 to take in an ON-OFF sampling sequence time-displaced groups of smoke samples and average them to eliminate from RAW_DATA background noise present in the detection chamber. Sources include interference from external light, RF emissions, and other sources of background noise. Such an ON-OFF sampling sequence can be performed by activating smoke sensing element 620 to take, for example, burst groups of twelve successive samples, with adjacent burst groups separated by 9 seconds. The ON interval represents the time the twelve samples are taken when light source 40 emits light, and the OFF interval represents the time between adjacent ON intervals when light source 40 does not emit light. The group of twelve samples taken in the ON sampling interval provides detector values representing chamber background noise and light signal, and the OFF sampling interval provides detector values representing chamber background noise. Because background noise is common to ON interval values and OFF interval values, computing average ON and OFF interval values and subtracting the average interval values gives a corrected signal value with background noise removed. The noise-corrected signal value would represent one of the RAW_DATA for processing. This represents one type of signal conditioning that can take place in signal acquisition unit 640 of FIG. 8.

Figure 13A:
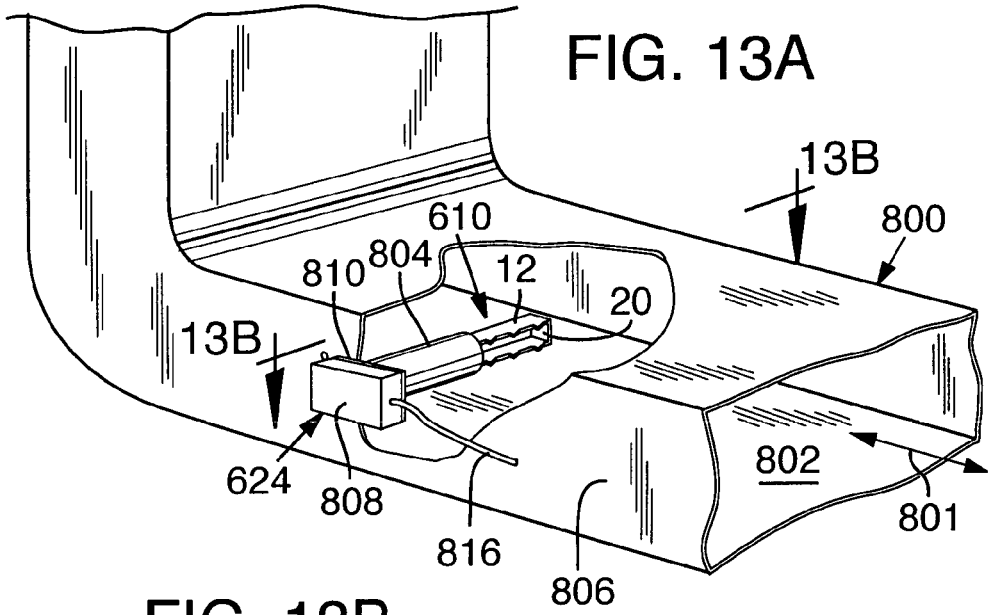
FIGS. 13A and 13B are, respectively, an isometric view and a sectional view taken along lines 13B—13B of FIG. 13A of a smoke detector of the present invention with its detection chamber placed within an air duct.
Figure 13B:
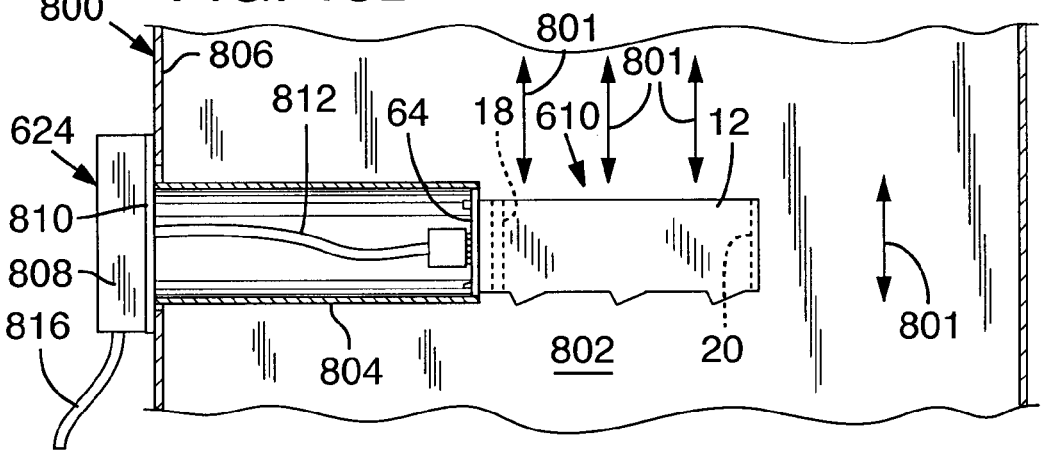

The smoke detector of the present invention has the further advantage of easy placement in building structures. For example, smoke detector 10 can be placed in an air duct or mounted to the ceiling. Smoke detector 10 is suitable for placement in the interior space of an air duct because detection chamber 12 is not affected by air duct wind current, which seriously affects the performance of ionization-type detectors, and is much less sensitive to air duct dust haze, which is a significant problem for light scattering photoelectric-type detectors. A typical prior art attempt to overcome air duct wind current and dust haze problems entailed mounting an air duct smoke detector on the outside surface of the air duct and inserting into the air duct two air sampling tubes to catch the air flow and direct it outside of the duct to pass through the smoke detector chamber. The air sampling tubes require correct insertion into the air duct to ensure proper air flow through them. This is so because air ducts have pockets of dead air or null pressure zones, which do not provide adequate, if any, air flow to the smoke detector chamber to make a measurement. FIGS. 13A and 13B show that any of the embodiments of the smoke detector of the present invention enables placement of its detection chamber entirely within the air duct, thereby altogether eliminating the air sampling tubes and mitigating the above-described air duct wind current and dust haze problems. (The following description of FIGS. 13A and 13B refers to smoke detector 610 by way of example only; the following description would apply to any of the embodiments of the smoke detector of the present invention.)

FIGS. 13A and 13B are isometric and cross-sectional views of smoke detector 610 with its detection chamber 12 placed within an air duct 800. FIG. 13A shows the horizontal orientation of light reflecting surfaces 18 and 20 of detection chamber 12 secured within duct 800. Such orientation causes detection chamber 12 to intercept the air flow, which is indicated by direction arrows 801, through duct 800 and thereby keep light reflecting surfaces 18 and 20 dust free. Detection chamber 12 is supported in interior space 802 of duct 800 at the free end of a tubular support arm 804 that extends through a side wall 806 of duct 800 and into interior space 802. Alarm control circuit 624 is contained in a temperature resistant housing 808 that is attached to the opposite end of support arm 804 and mounted With a temperature resistant seal 810 on the exterior surface of side wall 806 of duct 800. The distance between the side walls of detection chamber 12 on which walls light reflecting surfaces 18 and 20 are formed is smaller than the diameter or maximum width dimension of tubular support arm 804. These dimensions are set so that during installation detection chamber 12 carried on the free end of support arm 804 can fit through an access hole in side wall 806 of duct 800. Electric wires 812 connected to terminals 814 (FIG. 2A) of circuit board 64 pass through support arm 804 to alarm control circuit 624. Wires 816 connect alarm control circuit 624 to control panel 618 (FIG. 7).

Figure 14:
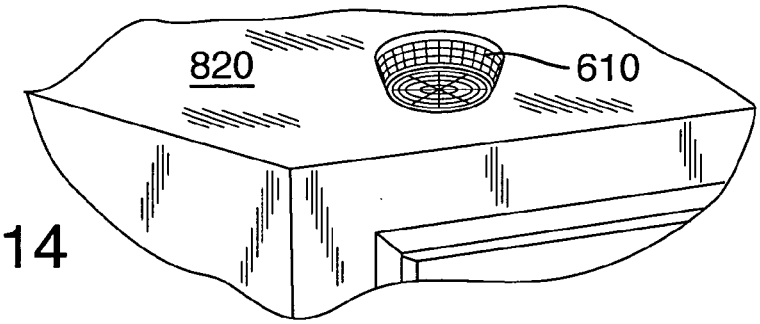
FIG. 14 is a pictorial view of a smoke detector of the present invention mounted to a room ceiling.

FIG. 14 is a pictorial view of any of the embodiments of the smoke detector (smoke detector 610 indicated in FIG. 14) of the present invention mounted to a room ceiling 820. The detection chamber would be oriented so that its light reflecting surfaces are vertically positioned, i.e., perpendicular, to ceiling 820.

Because the present invention spreads the light beam across detection chamber 12, the reflected light emerging from detection chamber 12, and therefore the output of light detector 54, represents an average concentration of smoke present. The average value of smoke concentration enables accurate determination of rate of rise of a smoke level between two threshold levels such as, for example, 0.5%/ft and 2.0%/ft. Smoke exhibiting a high rate of rise and persistence above the 2.0%/ft threshold level would indicate a flaming fire. Smoke exhibiting a high rate of rise but a rapid drop below the 2.0%/ft threshold would indicate transient smoke such as that produced by a lighted cigarette or a transient high humidity condition such as that produced by bathroom steam.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A rapidly responding, false detection immune smoke detector of a light obscuration type, comprising:

a light source from which a light beam propagates;

a light detector having a light receiving surface with a light detecting area and producing a signal in response to light incident on the light receiving surface;

a light reflective imaging assembly in optical association with the light source and the light detector, the imaging assembly including first and second spaced-apart optical components having respective first and second opposed light reflecting surfaces forming between them a spatial region that smoke particles can occupy, the first and second optical components having light directing properties that cooperate to reflect the light beam between the first and second light reflecting surfaces and to direct the light beam toward the light detector for incidence on its light receiving surface, and the first and second optical components controlling the light beam by providing it with a beam width that is sufficiently wide to render insignificant contributions of anomalous light reflections but that converges to illuminate the light receiving surface within the confines of the light detecting area and thereby cause the light detector to produce a signal corresponding to a concentration of the smoke particles occupying the spatial region;

a rate of change measurement detector operatively associated with the light detector to measure a rate of change of the concentration of smoke particles occupying the spatial region, the rate of change measurement detector responding to the signal produced by the light detector to determine an elapsed time between changes in concentrations of smoke particles between first and second smoke concentration threshold levels, wherein the first smoke concentration threshold level is less than the second smoke concentration threshold level and the rate of change measurement detector produces a signal indicating that a rate of rise of the concentration of smoke particles from the first smoke concentration threshold level to the second smoke concentration threshold level has exceeded a first predetermined threshold rate and the concentration of smoke particles persists above the second smoke concentration threshold level for a predetermined time; and an alarm threshold circuit to which an alarm smoke concentration threshold level is set, and in which the first smoke concentration threshold level is less than the alarm smoke concentration threshold level.

2. A rapidly responding, false detection immune smoke detector of a light obscuration type, comprising:

a light source from which a light beam propagates;

a light detector having a light receiving surface with a light detecting area and producing a signal in response to light incident on the light receiving surface;

a light reflective imaging assembly in optical association with the light source and the light detector, the imaging assembly including first and second spaced-apart optical components having respective first and second opposed light reflecting surfaces forming between them a spatial region that smoke particles can occupy, the first and second optical components having light directing properties that cooperate to reflect the light beam between the first and second light reflecting surfaces and to direct the light beam toward the light detector for incidence on its light receiving surface, and the first and second optical components controlling the light beam by providing it with a beam width that is sufficiently wide to render insignificant contributions of anomalous light reflections but that converges to illuminate the light receiving surface within the confines of the light detecting area and thereby cause the light detector to produce a signal corresponding to a concentration of the smoke particles occupying the spatial region; and a rate of change measurement detector operatively associated with the light detector to measure a rate of change of the concentration of smoke particles occupying the spatial region, the rate of change measurement detector responding to the signal produced by the light detector to determine an elapsed time between changes in concentrations of smoke particles between first and second smoke concentration threshold levels, wherein the first smoke concentration threshold level is less than the second smoke concentration threshold level and the rate of change measurement detector produces a signal indicating that a rate of rise of the concentration of smoke particles from the first smoke concentration threshold level to the second smoke concentration threshold level is less than a second predetermined threshold rate to indicate a long-term degradation of intensity of light incident on the light receiving surface of the light detector.

3. A rapidly responding, false detection immune smoke detector of a light obscuration type, comprising:

a light source from which a light beam propagates;

a light detector having a light receiving surface with a light detecting area and producing a signal in response to light incident on the light receiving surface; and a light reflective imaging assembly in optical association with the light source and the light detector, the imaging assembly including first and second spaced-apart optical components having respective first and second opposed light reflecting surfaces forming between them a spatial region that smoke particles can occupy, the first and second optical components having light directing properties that cooperate to reflect the light beam between the first and second light reflecting surfaces and to direct the light beam toward the light detector for incidence on its light receiving surface, and the first and second optical components controlling the light beam by providing it with a beam width that is sufficiently wide to render insignificant contributions of anomalous light reflections but that converges to illuminate the light receiving surface within the confines of the light detecting area and thereby cause the light detector to produce a signal corresponding to a concentration of the smoke particles occupying the spatial region, wherein the light directing properties of the first and second optical components cooperate to reflect the light beam multiple times between the first and second light reflecting surfaces to establish a smoke detection sensitivity for the smoke detector.

4. A rapidly responding, false detection immune smoke detector of a light obscuration type, comprising:

a light source from which a light beam propagates;

a light detector having a light receiving surface with a light detecting area and producing a signal in response to light incident on the light receiving surface; and a light reflective imaging assembly in optical association with the light source and the light detector, the imaging assembly including first and second spaced-apart optical components having respective first and second opposed light reflecting surfaces forming between them a spatial region that smoke particles can occupy, the first and second optical components having light directing properties that cooperate to reflect the light beam between the first and second light reflecting surfaces and to direct the light beam toward the light detector for incidence on its light receiving surface, and the first and second optical components controlling the light beam by providing it with a beam width that is sufficiently wide to render insignificant contributions of anomalous light reflections but that converges to illuminate the light receiving surface within the confines of the light detecting area and thereby cause the light detector to produce a signal corresponding to a concentration of the smoke particles occupying the spatial region, wherein one of the first and second light reflecting surfaces includes a pair of openings, the light beam emitted by the light source propagating through one of the pair of openings and the light beam received by the light detector after incidence on the first and second light reflecting surfaces propagating through the other one of the pair of openings.

5. A rapidly responding, false detection immune smoke detector of a light obscuration type, comprising:

a light source from which a light beam propagates;

a light detector having a light receiving surface with a light detecting area and producing a signal in response to light incident on the light receiving surface; and a light reflective imaging assembly in optical association with the light source and the light detector, the imaging assembly including first and second spaced-apart optical components having respective first and second opposed light reflecting surfaces forming between them a spatial region that smoke particles can occupy, the first and second optical components having light directing properties that cooperate to reflect the light beam between the first and second light reflecting surfaces and to direct the light beam toward the light detector for incidence on its light receiving surface, and the first and second optical components controlling the light beam by providing it with a beam width that is sufficiently wide to render insignificant contributions of anomalous light reflections but that converges to illuminate the light receiving surface within the confines of the light detecting area and thereby cause the light detector to produce a signal corresponding to a concentration of the smoke particles occupying the spatial region, wherein one of the first and second light reflecting surfaces includes a pair of openings, the light beam emitted by the light source propagating through one of the pair of openings and the light beam received by the light detector after incidence on the first and second light reflecting surfaces propagating through the other one of the pair of openings and wherein an optical axis extends between the first and second light reflecting surfaces and in which the openings included in the pair are positioned on opposite sides of the optical axis.

6. The smoke detector of claim 3, in which the opposed first and second light reflecting surfaces have surface normals and in which the first and second light reflecting surfaces are positioned so that their surface normals are parallel to each other.

7. The smoke detector of claim 3, in which the first light reflecting surface is curved, the first optical component has an opposite surface, and the light source and the light detector are positioned in proximity to the opposite surface of the first optical component.

8. The smoke detector of claim 3, in which the first and second light reflecting surfaces are curved.

9. The smoke detector of claim 8, in which each of the first and second optical components has an opposite surface, and one of the opposite surfaces is positioned in proximity to the light source and the light detector.

10. The smoke detector of claim 3, in which one of the first and second light reflecting surfaces is in the form of a concave optical surface and the other of the first and second light reflecting surfaces is in the form of a piano optical surface.

11. The smoke detector of claim 10, in which the concave optical surface is of spherical shape with a surface normal at an apex, the spherical optical surface being positioned so that its surface normal is normal to the piano optical surface.

12. A rapidly responding, false detection immune smoke detector of a light obscuration type, comprising:

a light source from which a light beam propagates;

a light detector having a light receiving surface with a light detecting area and producing a signal in response to light incident on the light receiving surface; and a light reflective imaging assembly in optical association with the light source and the light detector, the imaging assembly including first and second spaced-apart optical components having respective first and second opposed light reflecting surfaces forming between them a spatial region that smoke particles can occupy, the first and second optical components having light directing properties that cooperate to reflect the light beam between the first and second light reflecting surfaces and to direct the light beam toward the light detector for incidence on its light receiving surface, and the first and second optical components controlling the light beam by providing it with a beam width that is sufficiently wide to render insignificant contributions of anomalous light reflections but that converges to illuminate the light receiving surface within the confines of the light detecting area and thereby cause the light detector to produce a signal corresponding to a concentration of the smoke particles occupying the spatial region, wherein one of the first and second light reflecting surfaces is in the form of a concave optical surface and the other of the first and second light reflecting surfaces is in the form of a piano optical surface and wherein the first and second light reflecting surfaces are spaced apart by a distance to define a path length, and in which the concave optical surface has a focal length that is about twice the path length and an effective beam length that is about six times the path length.

13. The smoke detector of claim 3, in which an optical axis extends between the first and second light reflecting surfaces and in which, for at least one of the first and second light reflecting surfaces, the multiple reflections undergone by the light beam take place on both sides of the optical axis.

14. The smoke detector of claim 3, in which the light source includes a light-emitting diode.

15. The smoke detector of claim 14, in which the light-emitting diode emits light having a wavelength of less than about 800 nm.

16. The smoke detector of claim 3, in which the light beam is within a wavelength range of between about 350 nm and about 470 nm.

17. The smoke detector of claim 3, in which the light reflective imaging assembly is in the form of an integral unit.

18. A rapidly responding, false detection immune smoke detector of a light obscuration type, comprising:

a light reflective imaging assembly including a pair of spaced-apart, opposed light reflecting surfaces between which a concentration of smoke particles can enter;

a light source from which a light beam propagates in a direction for reflection by the light reflecting surfaces, the light beam reflecting off each one of the pair of light reflecting surfaces as it propagates through the light reflective imaging assembly, the light beam exiting the light reflective imaging assembly having an intensity corresponding to the concentration of smoke particles present between the light reflecting surfaces; and a light detector positioned to receive a light beam representing the concentration of smoke particles in the light reflective imaging assembly.

19. The smoke detector of claim 18, further comprising:

a light source modulator providing to the light source a sampling sequence of pulses that cause intermittent propagation of the light beam, the sampling sequence including an ON interval during which a first group of pulses causes the light beam to propagate and an OFF interval during which the light beam does not propagate;

the detector receiving the light beam representing the concentration of smoke particles and producing an ON state output signal during the ON interval and an OFF state output signal during the OFF interval, the ON state and OFF state output signals having a common background noise signal component; and a signal conditioner receiving the ON state and OFF state output signals and removing the common background noise signal component to produce a noise-corrected signal value representing the concentration of smoke particles present between the light reflecting surfaces during the sampling sequence.

20. The smoke detector of claim 19, in which the signal conditioner removes the common background noise signal component by computing average ON state output signal values and average OFF state output signal values and subtracting them to produce the noise-corrected signal value.

21. A false detection immune, light obscuration type smoke detector that is capable of detecting particles of different sizes, comprising:

a light reflective imaging assembly including a pair of spaced-apart, opposed light reflecting surfaces between which gas-borne particles can enter;

first and second light sources from which respective first and second light beams of different wavelengths propagate in directions for reflection by the light reflecting surfaces, the first and second light beams reflecting off each one of the pair of light reflecting surfaces as the first and second light beams propagate through the light reflective imaging assembly, the first and second light beams exiting the light reflective imaging assembly having intensities corresponding to concentrations of gas-borne particles of different ranges of sizes present between the light reflecting surfaces, the first and second ranges of sizes being determined by the wavelengths of, respectively, the first and second light beams; and a light detector positioned to receive a light beam representing at least one of the first and second ranges of sizes of the gas-borne particles in the light reflective imaging assembly.

22. The smoke detector of claim 21, further comprising pulse circuitry operatively associated with the first and second light sources to produce for reception by the light detector the light beam carrying noncoincident representations of the first and second ranges of sizes of the gas-borne particles.

23. The smoke detector of claim 21, in which the wavelength of the first light beam is less than about 500 nm.

24. The smoke detector of claim 23, in which the wavelength of the second light beam is greater than about 800 nm.

25. The smoke detector of claim 21, in which the first and second wavelengths are, respectively, less than about 500 nm and greater than about 800 nm, in which the light detector constitutes a first light detector, and in which the light beam constitutes a first measurement light beam representing the first range of sizes of gas-borne particles, so that the first light detector receives the first measurement light beam, and further comprising:

a second light detector that receives a second measurement light beam representing the second range of sizes of gas-borne particles; and a discriminator that receives signals produced by the first and second light detectors and corresponding to the respective first and second measurement light beams, the discriminator determining average sizes of the gas-borne particles present between the light reflecting surfaces and thereby distinguishing the gas-borne particles from one another by their origins as indicated by their sizes.

26. A smoke detector of an obscuration type configured for placement of its optical components within the interior of an air duct having a duct side wall with an exterior surface, the smoke detector monitoring the quality of air flowing in an air flow direction through the interior of the air duct, comprising:

a light reflective imaging assembly including a pair of spaced-apart, opposed light reflecting surfaces between which a concentration of smoke particles can enter and an optical axis extends;

a support configured to extend through an opening in the duct side wall and having first and second ends, the first end holding the light reflective assembly within the interior of the air duct in a desired orientation that positions the optical axis transversely of the direction of air flow within the air duct, and the second end being mechanically coupled to the side wall to secure the support and thereby set the light reflective assembly in the desired orientation;

a light source from which a light beam propagates in a direction for reflection by the light reflecting surfaces, the light beam reflecting off each one of the pair of light reflecting surfaces as it propagates through the light reflective imaging assembly, the light beam exiting the light reflective imaging assembly having an intensity corresponding to the concentration of smoke particles present between the light reflecting surfaces; and a light detector positioned to receive a light beam representing the concentration of smoke particles in the light reflective imaging assembly.

27. The smoke detector of claim 26, in which the light source and the light detector are mounted within the interior of the air duct and adjacent the light reflective imaging assembly.

28. The smoke detector of claim 26, further comprising an alarm control circuit contained in a temperature resistant housing that is coupled to the second end of the support and mounted with a temperature resistant seal on the exterior surface of the duct side wall.

29. The smoke detector of claim 26, in which the support includes a tubular arm that extends through the opening in the duct side wall and into the interior of the air duct.

30. The smoke detector of claim 29, further comprising an alarm control circuit that is coupled to the second end of the support, in which the light detector is held in position by the support and within the interior of the air duct, and in which the tubular arm provides a conduit for a communication link between the light detector and the alarm control circuit.

31. A rapidly responding, false detection immune smoke detector of a light obscuration type, comprising:

a light source from which a light beam propagates;

a light detector having a light receiving surface with a light detecting area and producing a signal in response to light incident on the light receiving surface;

a light reflective imaging assembly in optical association with the light source and the light detector, the imaging assembly including first and second spaced-apart optical components having respective first and second opposed light reflecting surfaces forming between them a spatial region that smoke particles can occupy, the first and second optical components having light directing properties that cooperate to reflect the light beam between the first and second light reflecting surfaces and to direct the light beam toward the light detector for incidence on its light receiving surface and thereby cause the light detector to produce a signal corresponding to a concentration of the smoke particles occupying the spatial region; and circuitry operatively associated with the light detector to acquire during a data gathering time interval data from the signal corresponding to the concentration of the smoke particles occupying the spatial region, the data gathering time interval being long as compared to the time of a slow fire, and the circuit determining an adjustment value for application to the signal produced by the light detector in response to a change in the acquired data that, in the absence of smoke, is greater than a preassigned operational tolerance after the data gathering time interval.

* * * * *